US010337257B2

(12) United States Patent
Zhang et al.

(10) Patent No.: US 10,337,257 B2
(45) Date of Patent: Jul. 2, 2019

(54) CUSTOMIZED DRILLING TOOLS

(71) Applicant: Smith International, Inc., Houston, TX (US)

(72) Inventors: Youhe Zhang, Spring, TX (US); Xiaoge Gan, Houston, TX (US); Huimin Song, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 29 days.

(21) Appl. No.: 15/630,420

(22) Filed: Jun. 22, 2017

(65) Prior Publication Data

US 2018/0002986 A1 Jan. 4, 2018

Related U.S. Application Data

(60) Provisional application No. 62/357,270, filed on Jun. 30, 2016, provisional application No. 62/357,087, filed on Jun. 30, 2016, provisional application No. 62/356,839, filed on Jun. 30, 2016.

(51) Int. Cl.

| | |
|---|---|
| ***E21B 10/60*** | (2006.01) |
| ***E21B 10/43*** | (2006.01) |
| ***E21B 10/50*** | (2006.01) |

(52) U.S. Cl.

CPC ..... *E21B 10/602* (2013.01); *E21B 10/43* (2013.01); *E21B 10/50* (2013.01)

(58) Field of Classification Search

CPC ..... E21B 10/602; E21B 10/43
USPC ..... 175/57
See application file for complete search history.

(56) References Cited

U.S. PATENT DOCUMENTS

| | | | | |
|---|---|---|---|---|
| 4,245,708 | A | 1/1981 | Cholet et al. | |
| 4,492,277 | A | 1/1985 | Creighton | |
| 4,540,055 | A | 9/1985 | Drummond et al. | |
| 4,733,735 | A | 3/1988 | Barr et al. | |
| 4,744,426 | A | 5/1988 | Reed | |
| 4,848,491 | A | 7/1989 | Burridge et al. | |
| 4,887,677 | A | 12/1989 | Warren et al. | |
| 5,199,511 | A | 4/1993 | Tibbitts et al. | |
| 5,284,215 | A | 2/1994 | Tibbitts | |
| 5,433,280 | A | 7/1995 | Smith | |
| 5,651,420 | A | 7/1997 | Tibbitts et al. | |
| 5,906,245 | A | 5/1999 | Tibbitts et al. | |
| 5,957,227 | A * | 9/1999 | Besson | E21B 10/602 175/393 |
| 6,302,223 | B1 | 10/2001 | Sinor | |
| 6,454,030 | B1 | 9/2002 | Findley et al. | |
| 2008/0029312 | A1 | 2/2008 | Hall et al. | |
| 2011/0192651 | A1 * | 8/2011 | Lyons | E21B 10/5673 175/428 |
| 2013/0160611 | A1 | 6/2013 | Matthews, III et al. | |
| 2015/0167397 | A1 | 3/2015 | Matthews, III | |

FOREIGN PATENT DOCUMENTS

| | | | |
|---|---|---|---|
| CN | 104353833 | A | 2/2015 |

* cited by examiner

*Primary Examiner* — Taras P Bemko

(57) ABSTRACT

A bit includes a bit body having at least one blade coupled to the bit body. The blade has a plurality of cutting elements at a nose region and a shoulder region of the blade. A plurality of fluid outlets are positioned on the blade such that at least 30% of the cutting elements have a fluid outlet within a distance that is two or three times a cutting element diameter away from a cutting face of the cutting element.

20 Claims, 19 Drawing Sheets

CUSTOMIZED DRILLING TOOLS

CROSS-REFERENCE TO RELATED APPLICATIONS

This application claims the benefit of, and priority to, U.S. Patent Application No. 62/357,270, filed Jun. 30, 2016 and titled "Drilling Tools with Customized Hydraulics for Cutting Elements," U.S. Patent Application No. 62/357,087, filed Jun. 30, 2016 and titled "Bit Body Having Compositional Gradient," and U.S. Patent Application No. 62/356,839, filed Jun. 30, 2016 and titled "3D Printed Body with 3D Layered Structure." Each of the foregoing applications is incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. A variety of drilling methods and tools may be utilized depending partly on the characteristics of the formation through which the wellbore is drilled.

A drilling system may use a variety of bits in the creation, maintenance, extension, and abandonment of a wellbore. Bits include drilling bits, mills, reamers, hole openers, and other cutting tools. Some drilling systems rotate a bit relative to the wellbore to remove material from the sides and/or bottom of the wellbore. Some bits are used to remove natural material from the surrounding geologic formation to extend or expand the wellbore. For instance, so-called fixed cutter or drag bits, or roller cone bits, may be used to drill or extend a wellbore, and a reamer or hole opener may be used to remove formation materials to extend or widen a wellbore. Some bits are used to remove material positioned in the wellbore during construction or maintenance of the wellbore. For example, bits are used to remove cement, scale, or metal casing from a wellbore during maintenance, creation of a window for lateral drilling in an existing wellbore, or during remediation.

Bit bodies may be fabricated from either steel or a hard metal "matrix" material. The matrix material can include tungsten carbide infiltrated with a binder alloy. Matrix bit bodies may have higher wear or erosion resistance, but may sacrifice toughness and may be more susceptible to impact damage than steel bit bodies.

Matrix bit bodies are manufactured by sintering, a process unique from infiltration. The sintering process involves the introduction of a refractory compound into a mold. The refractory may include a carbide of tungsten, titanium, or tantalum, or other specialized use materials. Before the carbide is introduced into the mold, it is mixed with a binder metal. The binder metal may be cobalt, but iron, nickel, and other materials may also be used. In the mold, the combination is heated to a point just below the melting point of the binder metal, and bonds are formed between the binder metal and the carbide by diffusion bonding or by liquid phase material transport.

Infiltration, on the other hand, involves the introduction of a refractory compound such as the above carbides into a mold with an opening at its top. A slug or cubes of binder metal are then placed against the refractory compound at the opening. The mold, refractory compound, and binder metal are placed into a furnace, and the binder metal is heated to its melting point. By capillary action and gravity, the molten metal from the slug infiltrates the refractory compound in the mold, thereby binding the refractory compound into a part. The infiltration binder may be a copper alloy including nickel, manganese, zinc, tin, other materials, or some combination thereof.

Cutting elements on a bit may be formed of an ultrahard material, such as a tungsten carbide or polycrystalline diamond (PCD). PCD may be used in various drilling operations as the material is very hard and wear resistant. PCD is, however, susceptible to thermal degradation during operations.

SUMMARY

In some embodiments, a bit includes a bit body, a blade coupled to the bit body, cutting elements coupled to the blade, and fluid outlets. The blade has a nose region and a shoulder region, and the cutting elements are located in the nose and shoulder regions. At least one of the cutting elements has a cutting face with a diameter. The fluid outlets are positioned such that at least 10% of the cutting elements have a fluid outlet positioned an outlet distance equal to or less than three times the diameter of the cutting face away from the cutting face of the cutting element.

In some embodiments, a bit has a bit body, a blade, cutting elements coupled to the blade, fluid outlets, and a primary conduit. The bit body has a central conduit and a chamber configured to convey drilling fluid through the bit body. The blade is coupled to the bit body, and the cutting elements are coupled to the blade. At least one of the cutting elements has a cutting face with a diameter, and at least 30% of the cutting elements have fluid outlet positioned within a distance equal to that diameter from the cutting face of the cutting element. The primary conduit provides fluid communication from the chamber to at least one of the fluid outlet. In some embodiments, one or more of the fluid conduits are on the blade and are axially, radially, or axially and radially recessed relative to the cutting elements.

In some embodiments, a method of removing material with a bit includes flowing a fluid through a drill string to a bit that includes cutting elements. Fluid is directed through a fluid conduit in the bit to a fluid outlet, and the fluid is discharged from the fluid outlet in a fluid path extending along or toward a cutting face of at least one of the cutting elements. In some embodiments, the fluid is discharged along a fluid path extending toward a cutting tip of the cutting face. In some further embodiments, the method may include obstructing at least some of the fluid conduits to restrict discharge of the fluid from one or more of the fluid outlets.

This summary is provided to introduce a selection of concepts that are further described in the detailed description, and is not intended to identify key or essential features of the claimed subject matter, nor is it intended to be used as an aid in limiting the scope of the claimed subject matter. Additional features and aspects of embodiments of the disclosure will be set forth in the description that follows. These and other features will become more fully apparent from the following description and appended claims, or may be learned by the practice of such embodiments as set forth herein.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. While some of the drawings may be schematic or exaggerated representations of concepts, other drawings may be drawn to scale and can be used for relative dimensions of various components. Such scale drawings are illustrative of some embodiments and are not to scale for other embodiments within the scope of the disclosure. Accordingly, understanding that the drawings depict some example embodiments, the embodiments will be described and explained with additional specificity and detail through the use of the accompanying drawings in which:

FIG. 4-1 is a side view of a bit, according to some embodiments of the present disclosure;

FIG. 4-2 is a perspective view of the bit of FIG. 4-1;

FIG. 4-3 is a bottom view of the bit of FIG. 4-1;

FIG. 5-1 is a bottom view of the blade of the bit of FIG. 4-1;

FIG. 5-2 is a cross-sectional view of the blade of FIG. 5-1;

FIG. 5-3 is another cross-sectional view of the blade of FIG. 5-1;

FIG. 6-1 is a perspective view of yet another bit, according to some embodiments of the present disclosure;

FIG. 6-2 is a bottom view of the bit of FIG. 6-1;

DETAILED DESCRIPTION

Some embodiments of this disclosure generally relate to devices, systems, and methods for cooling, cleaning, or lubricating (or combinations of cooling, cleaning, and lubricating) one or more cutting elements of a bit. More particularly, some embodiments of the present disclosure relate to bits having a plurality of fluid outlets that may increase operational lifetime, improve cooling, reduce the likelihood of cutting element or bit body failure, provide improved flushing of cuttings, or combinations thereof. While a drill bit for cutting through an earth formation is described herein, it should be understood that the present disclosure may be applicable to other bits such as mills, reamers, hole openers, and other bits used in downhole or other applications.

Figure 1:
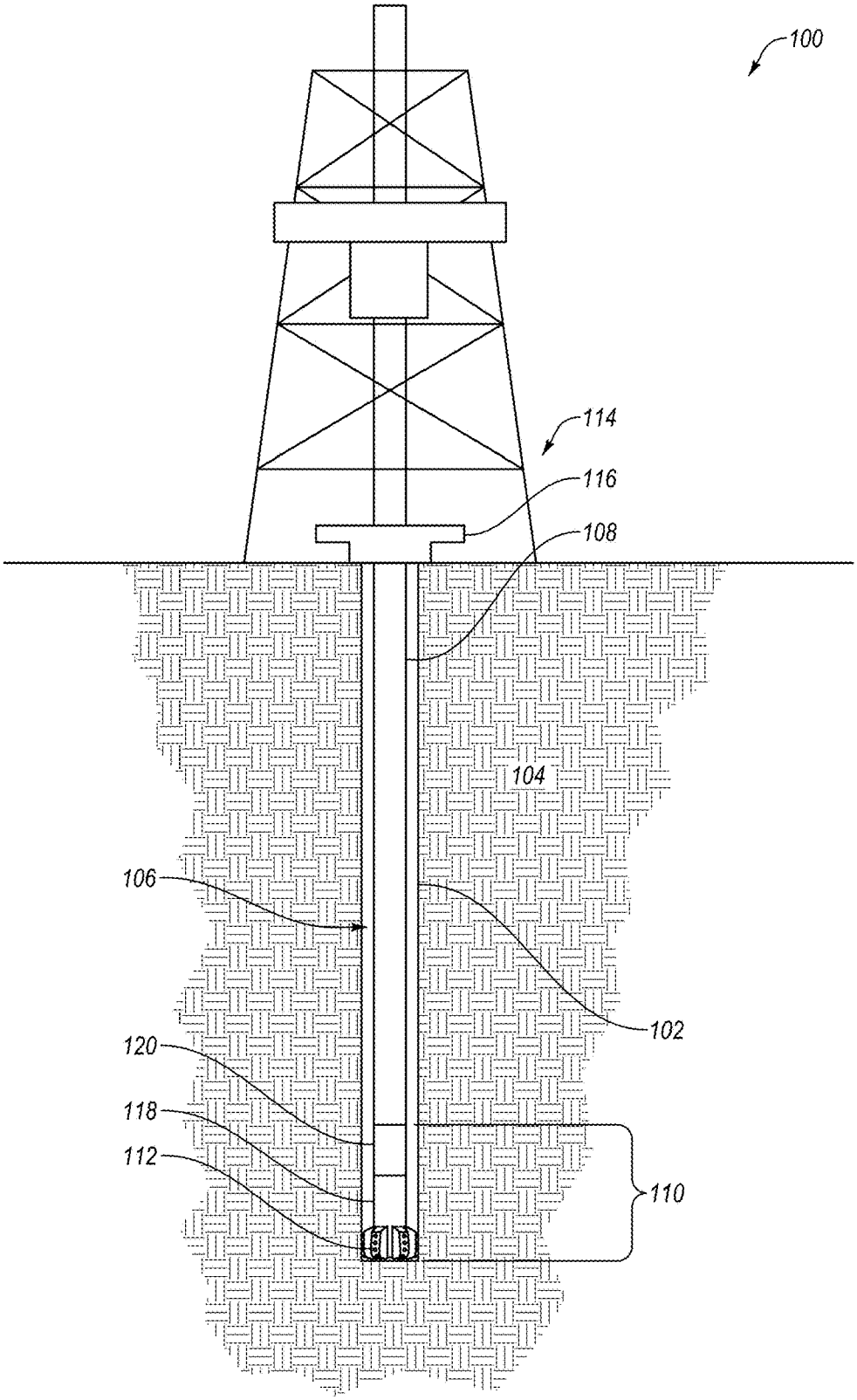
FIG. 1 is a schematic representation of a drilling system, according to embodiments of the present disclosure.

FIG. 1 shows one example of a drilling system 100 for forming a wellbore 102 in an earth formation 104. The drilling system 100 includes a drilling tool assembly 106 that extends downward into the wellbore 102. The drilling tool assembly 106 may include a drill string 108 and a bottomhole assembly ("BHA") 110 attached to a downhole end portion of drill string 108. The BHA 110 may include a bit 112 for drilling, milling, reaming, or performing other cutting operations within the wellbore.

The drill string 108 may include several joints of drill pipe connected end-to-end through tool joints. The drill rig 114 may include a top drive or rotary table 116 that rotates the drill string 108, and the drill string 108 optionally transmits rotational power and torque from the drill rig 114 to the BHA 110. The drill string 108 may also transmit drilling fluid through a central bore. In some embodiments, the drill string 108 may further include additional components such as subs, pup joints, jars, vibration tools, stabilizers, sensors, etc. The drill string 108 may include slim drill pipe, coiled tubing, or other materials that transmit drilling fluid through a central bore, which may not transmit rotational power. Where rotational power is used, a downhole motor (e.g., a positive displacement motor, turbine-driven motors, electric motor, etc.) may be included in the BHA 110. The drill string 108 provides a hydraulic passage through which drilling fluid is pumped from the surface. The drilling fluid discharges through selected-size nozzles, jets, or other orifices in the bit 112 (or other components of the drill string 108 or BHA 110) for the purposes of cooling, cleaning, or both cooling and cleaning the bit 112 and cutting structures thereon, for lifting cuttings out of the wellbore 102 as downhole operations are performed, or for other purposes (e.g., cleaning, powering a motor, etc.).

The BHA 110 may include the bit 112 or other components. An example BHA 110 may include additional or other components (e.g., coupled between to the drill string 108 and the bit 112). Examples of additional BHA components include drill collars, stabilizers 118, measurement tools 120 (e.g., measurement-while-drilling ("MWD") tools or logging-while-drilling ("LWD") tools), downhole motors, underreamers, section mills, hydraulic disconnects, jars, vibration or dampening tools, other components, or combinations of the foregoing. For example, other measurement tools 120 may include accelerometers to measure the movement of the bit 112, a torque meter to measure forces on the bit 112, sensors to measure weight on the bit 112, other sensing or logging tools, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 106, the drill string 108, or a part of the BHA 110 depending on their locations or functions in the drilling system 100.

The bit 112 in the BHA 110 may be any type of bit suitable for degrading downhole materials. For example, the bit 112 may be a drill bit suitable for drilling the earth formation 104. Example types of drill bits used for drilling earth formations are fixed-cutter or drag bits, roller cone bits, impregnated bits, or coring bits. In other embodiments, the bit 112 may be a mill used for removing metal, composite, elastomer, or other materials downhole. For instance, the bit 112 may be used with a whipstock (not shown) to mill a window into a casing that lines at least a portion of the wellbore 102. The bit 112 may also be a section mill used to mill away an entire section of the casing, or a junk mill used to mill away tools, plugs, cement, or other materials within the wellbore 102. Swarf or other cuttings formed by use of a mill may be lifted to surface, or may be allowed to fall downhole.

Figure 2:
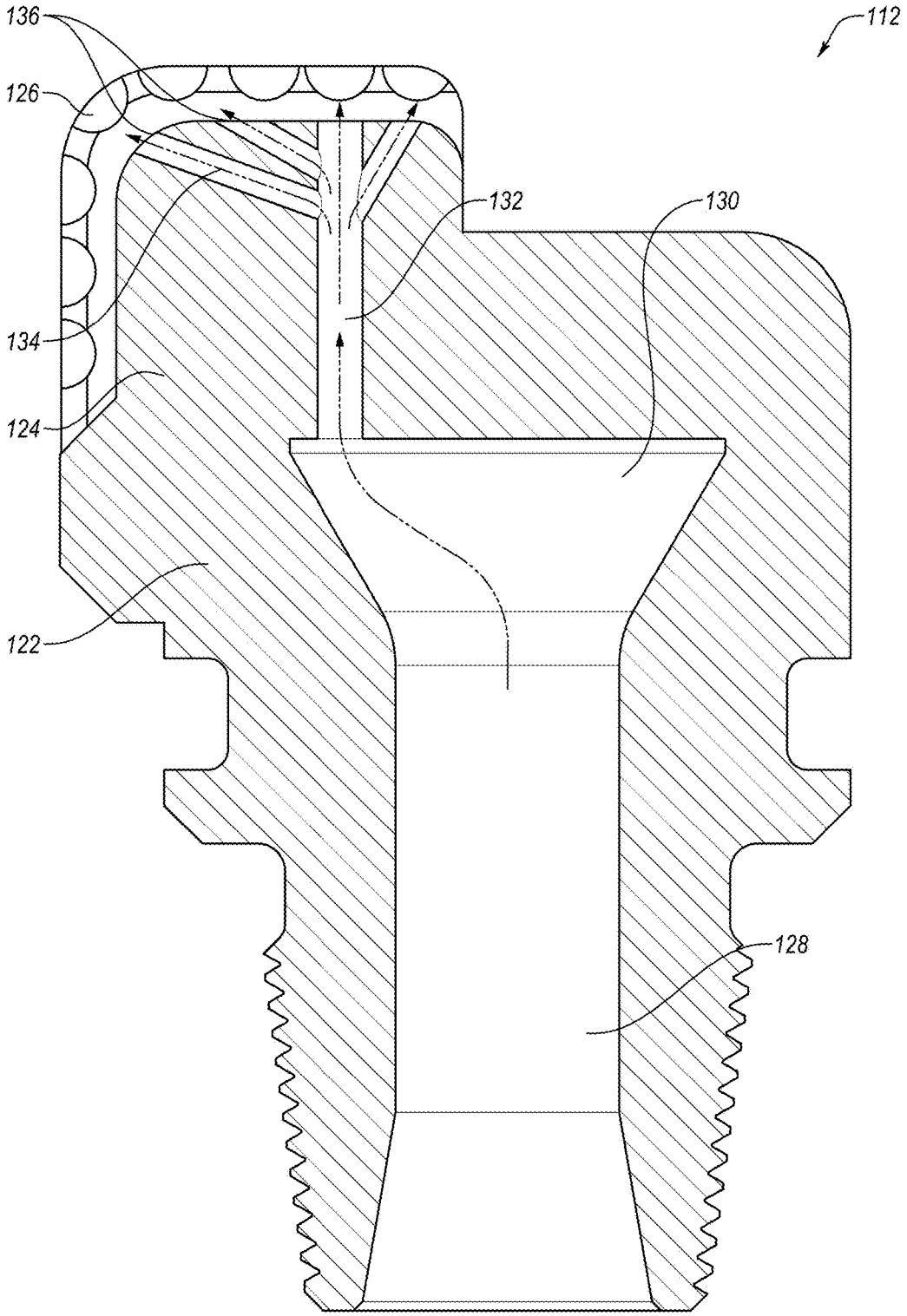
FIG. 2 is a side cross-sectional schematic representation of a bit having hydraulic fluid conduits, according to some embodiments of the present disclosure.

Referring to FIG. 2, an embodiment of a bit 112 is shown in side cross-section. The bit 112 has a bit body 122 with one or more blades 124 (one is shown in FIG. 2) coupled thereto. The blades 124 may have a plurality of pockets 126 formed on the surface thereof. Each of the plurality of pockets 126 may be configured to receive and retain a single cutting element (not shown), or a pocket may be configured to receive an assembly that includes multiple cutting elements. The cutting elements may include an ultrahard material for removing material from an earth formation, a manmade structure, or other object through which the bit 112 is desired to cut.

As used herein, the term "ultrahard" is understood to refer to those materials known in the art to have a grain hardness of about 1,500 HV (Vickers hardness in kg/mm2) or greater. Some such ultrahard materials are capable of demonstrating physical stability at temperatures above 750° C., and for certain applications above 1,000° C., and may be formed from consolidated materials. Such ultrahard materials can include but are not limited to metal carbides (e.g., tungsten carbide, titanium carbide, chromium carbide, niobium carbide, tantalum carbide, vanadium carbide, etc.), cobalt cemented metal carbide, metal alloy cemented metal carbide, diamond, polycrystalline diamond (PCD), leached metal catalyst PCD, non-metal catalyst PCD, hexagonal diamond (Lonsdaleite), cubic boron nitride (cBN), polycrystalline cBN (PcBN), binderless PCD or nanopolycrystalline diamond (NPD), Q-carbon, binderless PcBN, diamond-like carbon, boron suboxide, aluminum manganese boride, metal borides, boron carbon nitride, and other materials in the boron-nitrogen-carbon-oxygen system which have shown hardness values above 1,500 HV, as well as combinations of the above materials. In at least one embodiment, the cutting element may be a monolithic PCD. For example, the cutting element may consist of a PCD compact without an attached substrate or metal catalyst phase. In some embodiments, the ultrahard material may have a hardness value above 3,000 HV. In other embodiments, the ultrahard material may have a hardness value above 4,000 HV. In yet other embodiments, the ultrahard material may have a hardness value greater than 80 HRa (Rockwell hardness A).

Some ultrahard materials (such as PCD) may be susceptible to thermal degradation due to increased temperatures of the cutting element during operation of the bit 112. For instance, PCD may have a cobalt or other metal-based interstitial phase with the bonded diamond grains. The diamond phase and the interstitial phase have different coefficients of thermal expansion. When the cutting element is heated during operation (e.g., through frictional heating between the cutting element an earth formation), the phases of the cutting element expand at different rates, generating internal strain in the cutting element material. The additional internal strain increases the likelihood of failure of the cutting element. According to at least some embodiments of the present disclosure, the bit 112 may provide cooling at or near the pockets 126 to cool the cutting elements. Such cooling can be directed directly to the cutting elements to cool the cutting elements to reduce the thermal expansion (and relative differences in thermal expansion) in a diamond and interstitial phase of the cutting element, and thereby extend the operational life of the cutting elements.

The bit 112 may have a central conduit 128 into which a drilling fluid may be conveyed, as described in relation to FIG. 1. The drilling fluid may be water, drilling mud, or another fluid that provides lubrication and cooling to the bit 112. The drilling fluid may also be used to flush cuttings from the bit 112 surface and carry the cuttings uphole (or otherwise away from the cutting region). In some bits, the drilling fluid is directed through a bit body to a small number of nozzles exiting the bit body in junk slot or fluid course regions between blades. A relatively high volume of fluid may flow through each nozzle to flush cuttings from the bit. Such nozzles are often limited in their placement and orientation due to their comparatively large size. For example, a conventional nozzle is too large in diameter to be positioned on a blade 124, particularly without disrupting the cutting profile of the bit 112.

As shown in FIG. 2, in some embodiments, a central conduit 128 may direct drilling fluid to a chamber 130. In some embodiments, the chamber 130 may be a crowfoot chamber, as shown in FIG. 2. In other embodiments, the chamber 130 may have other shapes or configurations to distribute fluid pressure throughout the chamber 130 and to a plurality of conduits extending from the chamber 130. For example, one or more primary conduits 132 may extend from the chamber 130 or central conduit 128 and provide fluid communication from the respective chamber 130 or central conduit 128 to a surface of the blade 124. The primary conduits 132 may branch within the blades 124 into cooling, cleaning, or other fluid conduits 134 that direct drilling fluid out of fluid outlets 136 formed on the blades themselves. The fluid outlets 136 may be smaller than conventional nozzles in diameter, thereby allowing the fluid conduits 136 to be located in more locations on the bit 112 and provide more even flow of drilling fluid, and hence cleaning and cooling, to the cutting elements and to the bit 112.

Figure 3:
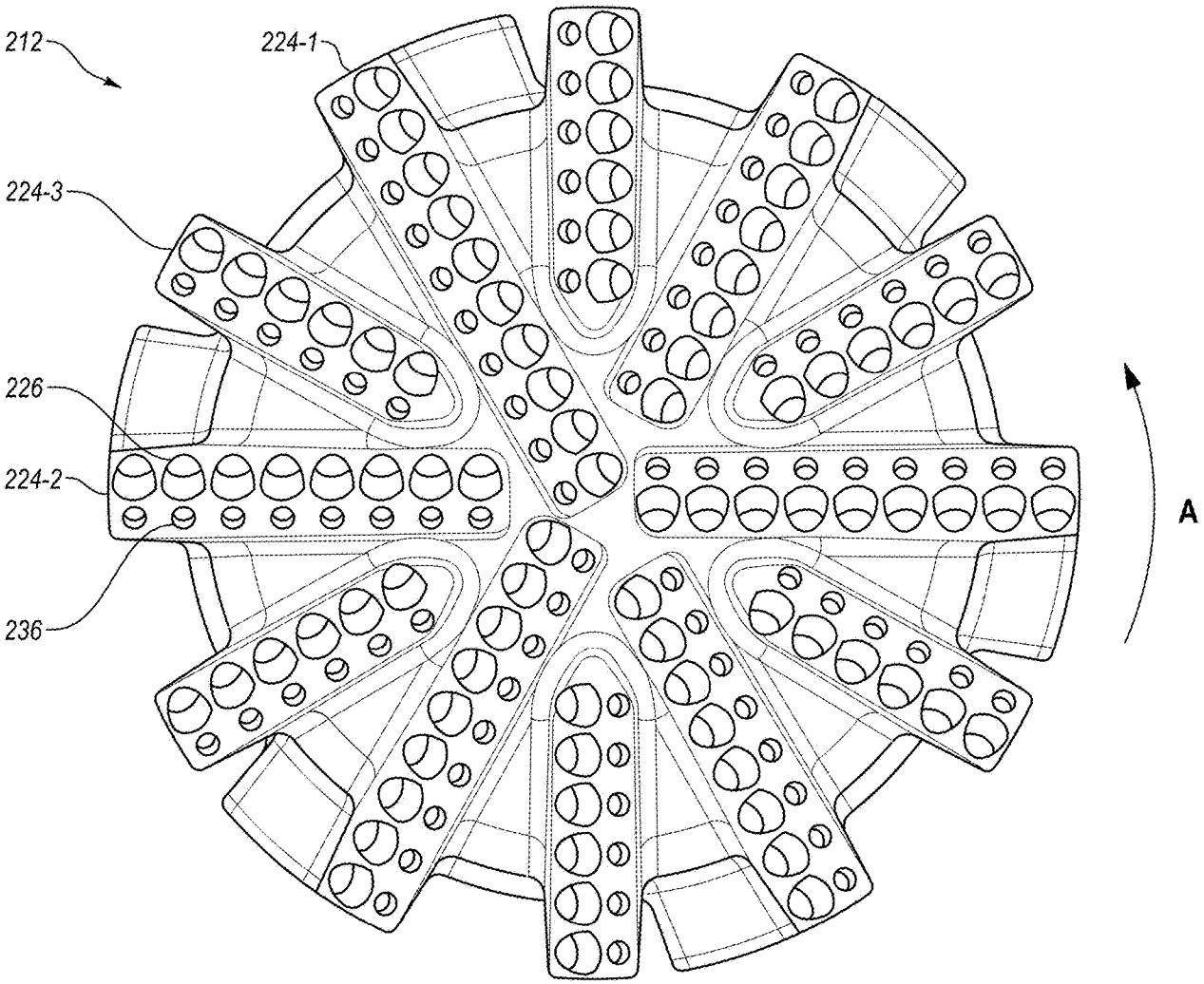
FIG. 3 is a bottom view of another bit having hydraulic fluid conduits, according to some embodiments of the present disclosure.

As shown in FIG. 3, in some embodiments of a bit 212, fluid outlets 236 may be provided directly on a primary blade 224-1, a secondary blade 224-2, or a tertiary blade 224-3, (collectively blades 224) or some combination of the foregoing. In the illustrated embodiment, each tertiary blade 224-3 is located between a primary blade 224-1 and a secondary blade 224-2, such that there are twice as many (six) tertiary blades 224-3 as either primary blades 224-1 (three) or secondary blades 224-2 (three). The illustrated design is, however, merely illustrative, and in some embodiments different numbers of primary blades 224-1, secondary blades 224-2, or tertiary blades 224-3 may be used. In some embodiments, there may be no tertiary blades 224-3, and each blade between primary blades 224-1 may be a secondary blades. The smaller diameter of the fluid outlets 236 relative to conventional nozzles, as well as the use of more fluid outlets 236 nearer the cutting elements to cool the cutting elements and flush away cuttings, may allow for a denser blade design of the bit 212, such that a bit 212 may have twelve or more blades 224 positioned on the bit 212. The denser blade design of the bit 212 may allow for smoother cutting profiles, longer cutting element operational lifetime, more efficient removal of harder formations, or combinations thereof. In some embodiments, the denser blade design of the bit 212 may be used to cut hard formations, which may tend to break into smaller cuttings that can be more easily evacuated through smaller fluid courses between the blades 224. In other embodiments, however, the bit 212 may be used in softer formations.

In some embodiments, the bit 212 has one fluid conduit 236 for each pocket 226 (corresponding to one fluid conduit 126 for each cutting element). For example, a fluid conduit 236 may be positioned in front of the pocket 226, to lead the pocket 226 in the direction of rotation (shown by arrow A). A fluid conduit 236 located in such a position may provide drilling fluid to the face of a cutting element positioned in the pocket 226 (and particularly to the cutting tip of the cutting element), thereby directly cooling, flushing, and lubricating the cutting element to extend the operational lifetime of the cutting element. In some embodiments, such as that shown in FIG. 3, the fluid conduit 236 and the pockets 226 or cutting elements may be formed in the same surface of the blade 224. In other embodiments, however, a fluid conduit may be on a different surface than the pocket 226 or cutting element. For instance, as shown in FIGS. 4-1 to 4-3, at least some fluid outlets formed on the blade may be on a surface that is axially, radially, or both axially and radially recessed relative to the cutting elements (including the cutting face of a cutting element).

Figures 1, 4:
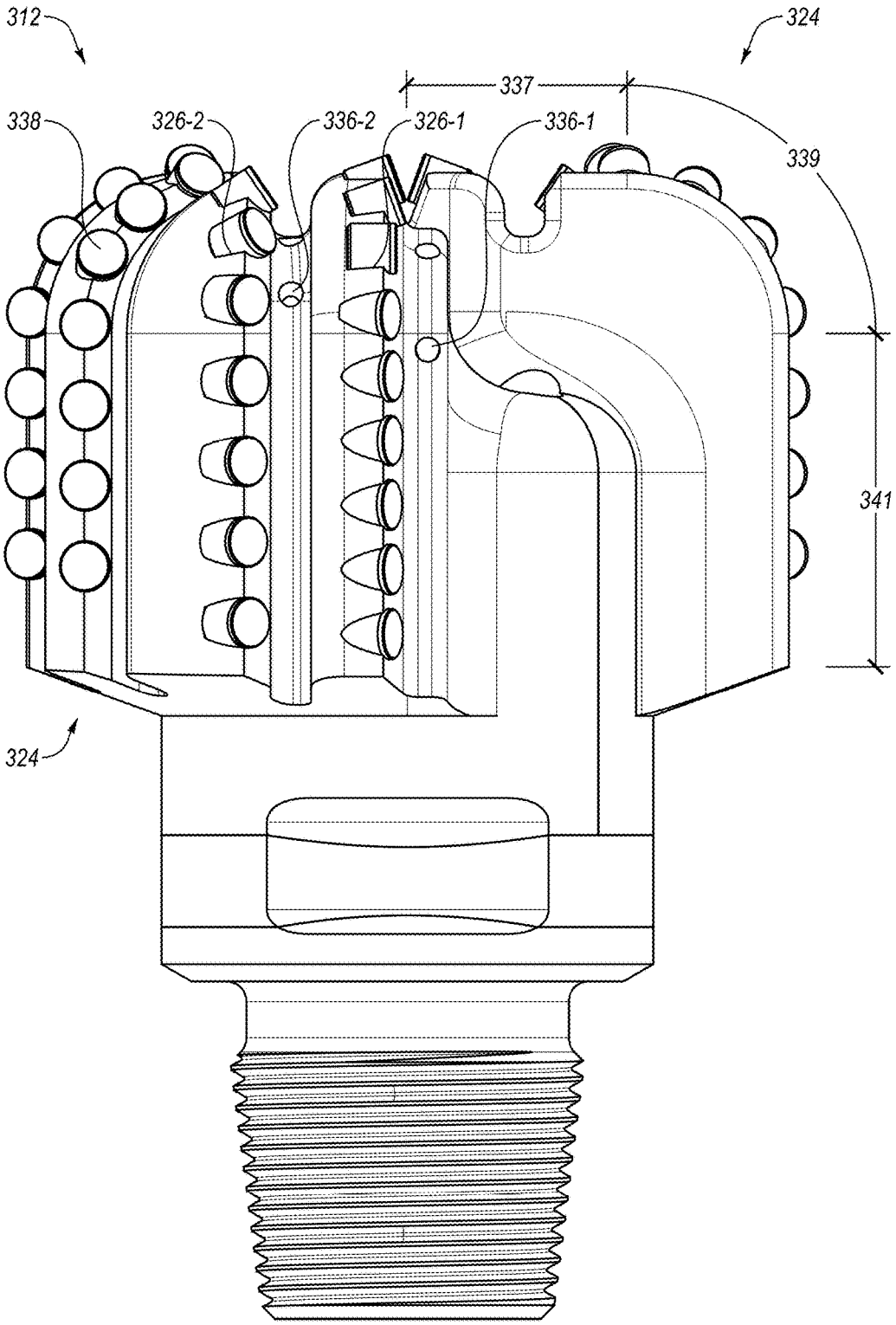
Figures 2, 4:
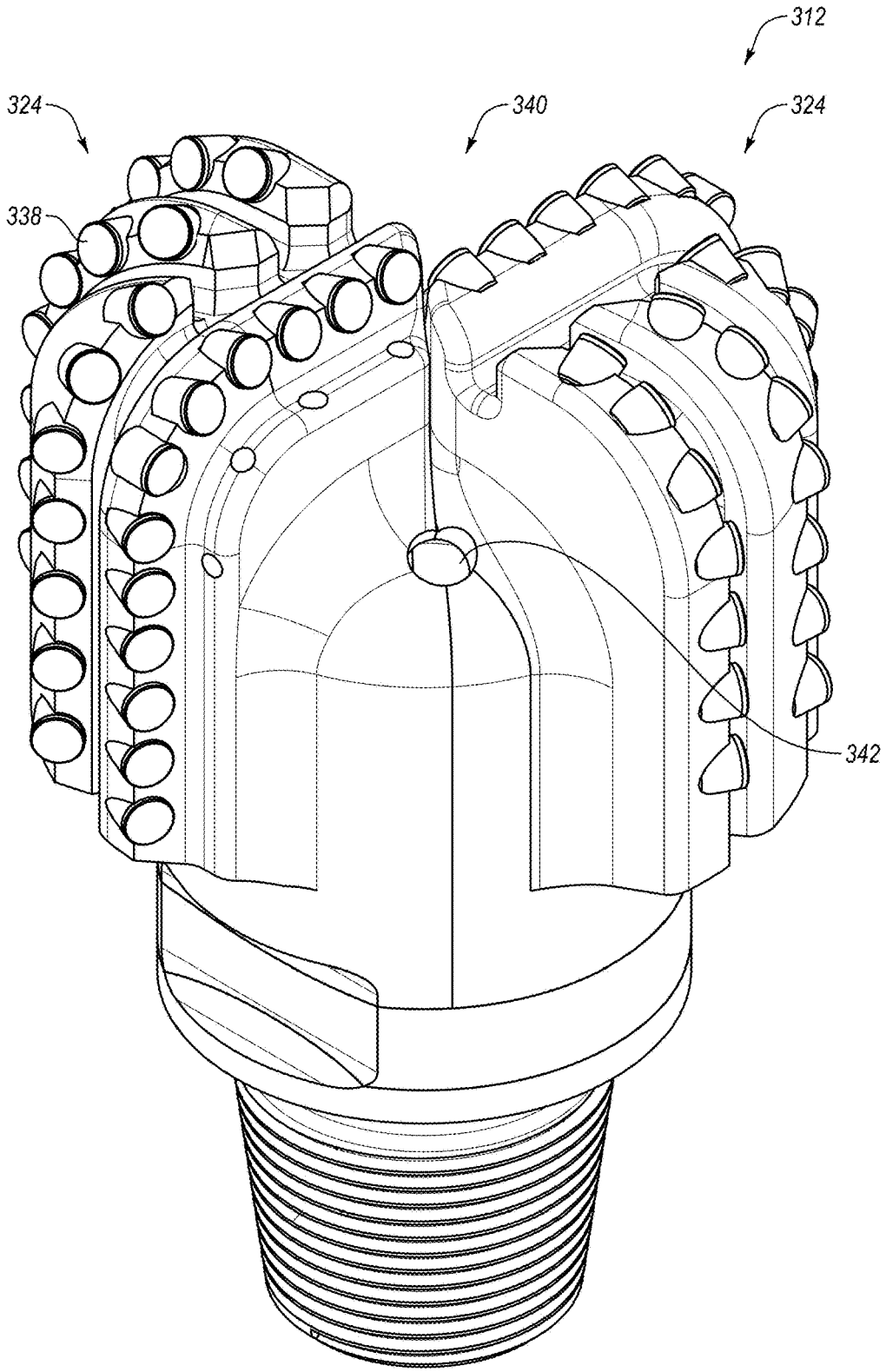
Figures 3, 4:
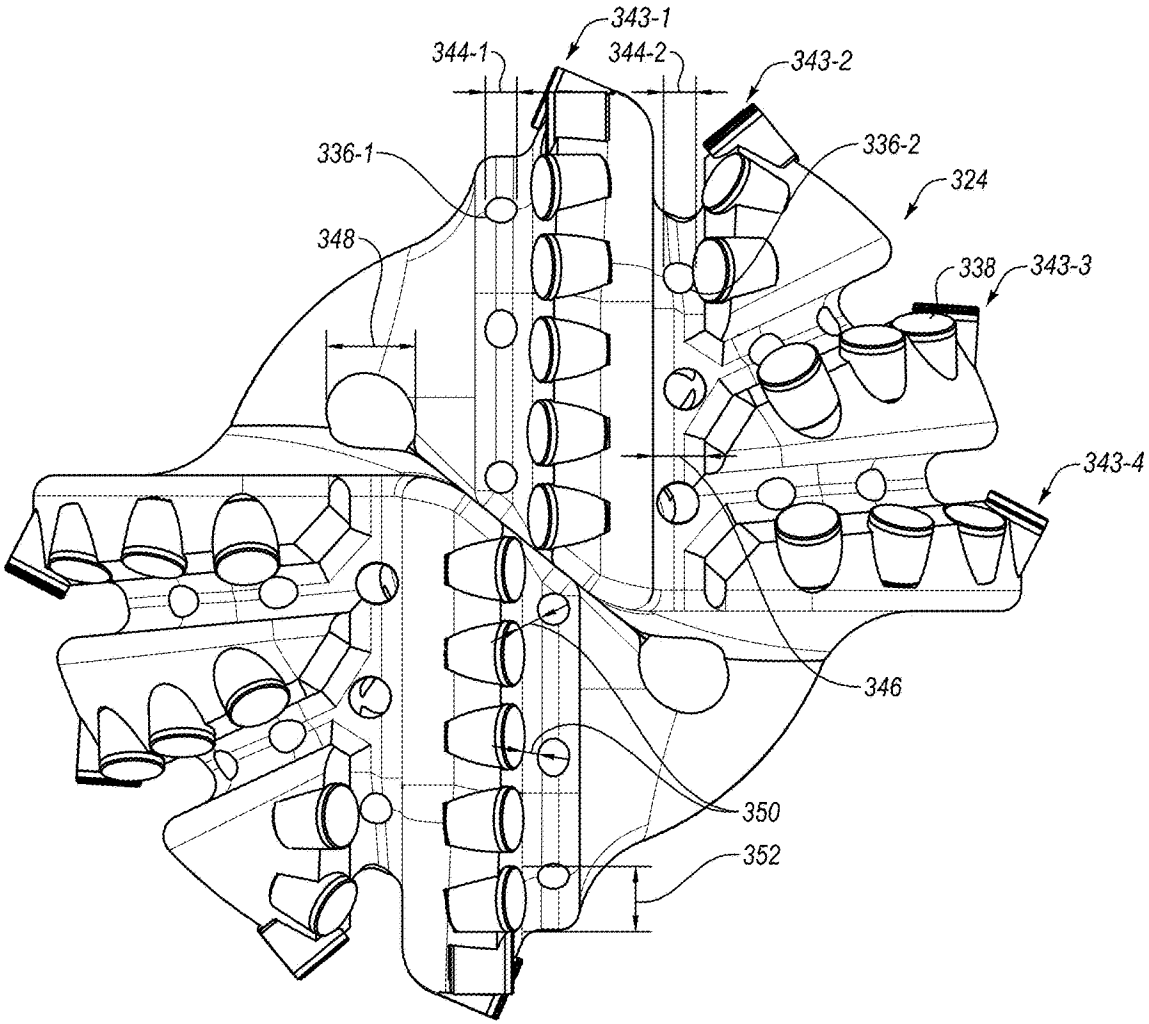

FIG. 4-1 illustrates another embodiment of a bit 312, according to some embodiments of the present disclosure. The bit 312 includes cutting elements 338 coupled to one or more blades 324 having a nose region 337, a shoulder region 339, and a gage region 341. At least a portion of the cutting elements 338 may be positioned in pockets 326 on the nose region 337 and the shoulder region 339. In some embodiments, a blade 324 may have a row of primary pockets 326-1 and a row of secondary pocket 326-2. For example, a blade 324 may have a row of primary cutting elements 338 on the blade 324 in the row of primary pockets 326-1 and a row of secondary cutting elements 338 positioned in the secondary pockets 326-2. The row of secondary pockets 326-2 may be positioned rotationally behind the primary pockets 326-1 relative to a rotational direction of the bit 312. The cutting elements 338 in the primary pockets 326 may therefore rotationally lead the cutting elements in the secondary pockets 326-2.

In some embodiments, at least one primary fluid outlet 336-1 may be positioned in front of (i.e., rotationally lead) the primary pockets 326-1. In the same or other embodiments a row, series, array, or other set of primary fluid outlets 336-1 may be positioned in front of the primary pockets 326-1 to rotationally lead the cutting elements 338 in the primary pockets 326-1. In some embodiments, at least one secondary fluid outlet 336-2 may be positioned in front of, to rotationally lead, the secondary pockets 326-2. In the same or other embodiments, a row, series, array, or other set of secondary fluid outlets 336-2 may be positioned in front of the secondary pockets 326-2 relative to a rotational direction of the bit 312. The secondary fluid outlets 336-2 may be rotationally behind the cutting elements 338 in the primary pockets 326-1 in some embodiments of the present disclosure. Because the fluid outlets described herein have a diameter less than that of a conventional nozzle, the fluid outlets may be positioned on a blade 324 and not simply in a junk slot, fluid course, or other channel or location between blades 324.

While the secondary outlets 336-2 are described herein in relation to the secondary pockets 326-2 or cutting elements 338 in the secondary pockets 326-2, it should be understood that additional rows of secondary outlets 336-2 may be located on the blade 324 when additional (i.e., tertiary, quaternary, etc.) rows of pockets or cutting elements 338 are positioned on the blade 324. In other words, the primary outlets 336-1 may be positioned rotationally in front of the primary pockets 326-1 and the secondary outlets 336-2 may be positioned elsewhere on the blade 324 rotationally in front of one or more other rows of pockets or cutting elements behind the primary row. In some embodiments, the outlets 336 may be used in connection with cutting elements not be located within pockets (e.g., integral with the blade).

In some embodiments, the cutting elements 338 in the nose region 337, the shoulder region 339, or in both the nose and shoulder regions 337, 339 may be cooled, cleaned, or lubricated by a drilling fluid provided through the fluid outlets. As will be described in more detail in relation to FIG. 4-3, according to some embodiments, at least 10% of the cutting elements 338 may have a fluid outlet 336 positioned in close proximity thereto. For instance, at least 10% of the cutting elements 338—which may include each cutting element in the bit or each cutting element in a particular region, depending on the manner described—may have a fluid outlet 336 within a distance equal to or less than twice the cutting element diameter away from the cutting face of the cutting element 338. In some embodiments, the cutting tip (i.e., the portion of the cutting element which is primarily used to cut the formation or other workpiece by shearing, impacting, gouging, etc.), will be within a distance of less than twice or less than three times the cutting element diameter of the cutting element 338 from a fluid outlet 336.

The embodiment of a bit 312 is shown in a perspective view in FIG. 4-2. The bit 312 may have a plurality of blades 324 oriented at angular intervals about the bit 312. In some embodiments, the plurality of blades 324 may be oriented at equal intervals about the bit 312, such as centered at the 180° intervals as shown in FIG. 4-2. In other embodiments, more than two blades 324 may be used, blades may be at other intervals, or unequal intervals may be used when orienting blades 324 about the bit 312. The blades 324 may be spaced apart with a fluid course or junk slot 340 positioned between the blades 324 to allow flow of fluid, cuttings, or other materials through the junk slots 340.

In some embodiments, the junk slots 340 may provide clearance to flow drilling fluid or other materials around the bit 312 in an uphole or downhole direction. For example, the junk slots 340 may provide clearance for cuttings, swarf, debris, drilling particles, or other particulates in the drilling fluid to flow around and upward past the bit 312, thereby flushing material from the space around the bit 312 during cutting operations and as the materials return to the surface of a wellbore. In other embodiments, the junk slots 340 may provide clearance for materials to flow around and downward past the bit 312 to flush material from space around the bit 312 during cutting operations.

In some embodiments, a nozzle opening 342 may be positioned on the bit 312 in one or more junk slots 340. The nozzle opening 342 may provide drilling fluid from inside the bit 312 to the junk slot 340. The nozzle opening 342 may provide a larger volume of fluid flow that a fluid outlet positioned on the blades 324. In some embodiments, an amount of fluid flow through the nozzle opening 342 may be between 150% and 1000% greater than the amount of fluid flow through a fluid outlet on a blade 324. For instance, the amount of fluid flow through the nozzle opening 342 may be within a range having an upper value, a lower value, or upper and lower values including any of 150%, 200%, 250%, 300%, 350%, 400%, 450%, 500%, 750%, 1000%, or any value therebetween, compared to the amount of fluid flow through a fluid outlet on a blade 324. For example, the nozzle opening 342 may allow an amount of fluid flow greater than 150% of the fluid flow of a fluid outlet. In other examples, the nozzle opening 342 may allow an amount of fluid flow greater than 200% of the fluid flow of a fluid outlet. In yet other examples, the nozzle opening 342 may allow an amount of fluid flow greater than 300% of the fluid flow of a fluid outlet, or between 250% and 400% of the fluid flow of a fluid outlet. In other embodiments, the fluid flow through the nozzle opening 342 may be less than 150% or greater than 1000% of the fluid flow through a fluid outlet on a blade 324.

FIG. 4-3 illustrates a bottom view of the nose region and shoulder region (as described in relation to FIG. 4-1) of the blade 324 shown in FIGS. 4-1 and 4-2. The blade 324 includes primary fluid outlets 336-1 and secondary fluid outlets 336-2. The fluid outlets 336 may each have an equal outlet diameter and shape, or the fluid outlets 336 may have varying outlet diameters or shapes, as shown in FIG. 4-3. In some embodiments, the fluid outlets 336 may have outlet diameters that vary at least partially based upon the work rate of nearest cutting elements 338 (e.g., the volume of material removed by the cutting element during period of time or at a predetermined cutting element velocity). For example, a fluid outlet 336 proximate to a cutting element 338 with a higher work rate may having a larger outlet diameter to provide greater fluid flow to the cutting element 338 with a higher work rate. In some embodiments, the additional fluid flow may provide additional cleaning (i.e., clearance of debris and material) of the cutting element 338. In the same or other embodiments, the additional fluid flow may provide additional cooling to the cutting element 338. In at least some embodiments, the additional cleaning or cooling may increase the operational lifetime of the cutting element 338. In some embodiments, differences in size may be used where fluid outlets 336 are used for cooling, cleaning, or providing flow to different numbers of cutting elements 338. For instance, a fluid outlet 336 directing fluid flow to a single cutting element 338 may have a smaller size than a fluid outlet 336 directing fluid flow to two or more cutting elements 338. Similarly, a fluid outlet 336 directing flow to multiple cutters may have a more elongated shape, in some embodiments, to disperse the flow more than would a circular fluid outlet 336. Combinations of the foregoing may also be used.

In some embodiments, one or more of the primary fluid outlets 336-1 have a primary outlet diameter 344-1 in a range having an upper value, a lower value, or upper and lower values including any of 0.075 in. (1.91 mm), 0.100 in. (2.54 mm), 0.200 in. (5.08 mm), 0.300 in. (7.62 mm), 0.400 in. (10.16 mm), 0.500 in. (12.72 mm), 0.600 in. (15.24 mm), 0.700 in. (17.78 mm), 0.800 in. (20.32 mm), 0.900 in. (22.86 mm), 1.000 in. (25.40 mm), or any values therebetween. For example, a primary outlet diameter 344-1 may be greater than 0.200 in. (5.08 mm). In other examples, a primary outlet diameter 344-1 may be less than 1.000 in. (25.40 mm). In yet other examples, a primary outlet diameter 344-1 may be in range of 0.200 in. (5.08 mm) to 1.000 in. (25.40 mm). In further examples, a primary outlet diameter 344-1 may be in range of 0.200 in. (5.08 mm) to 0.500 in. (12.72 mm). In still other embodiments, a primary outlet diameter 334-1 may be less than 0.075 in. (1.91 mm) or greater than 1.000 in. (25.40 mm).

In some embodiments, the secondary fluid outlets 336-2 have a secondary outlet diameter 344-2 that is the same as, or different from, a primary outlet diameter 344-1. For instance, a secondary outlet diameter 344-2 of one or more secondary fluid outlets 336-2 may be in a range having an upper value, a lower value, or upper and lower values including any of 0.075 in. (1.91 mm), 0.100 in. (2.54 mm), 0.200 in. (5.08 mm), 0.300 in. (7.62 mm), 0.400 in. (10.16 mm), 0.500 in. (12.72 mm), 0.600 in. (15.24 mm), 0.700 in. (17.78 mm), 0.800 in. (20.32 mm), 0.900 in. (22.86 mm), 1.000 in. (25.40 mm), or any values therebetween. For example, a secondary outlet diameter 344-2 may be greater than 0.075 in. (1.905 mm). In other examples, the secondary outlet diameter 344-2 may be less than 1.000 in. (25.40 mm). In yet other examples, the secondary outlet diameter 344-2 may be in a range of 0.200 in. (5.08 mm) to 1.000 in. (25.40 mm). In further examples, the secondary outlet diameter 344-2 may be in a range of 0.200 in. (5.08 mm) to 0.500 in. (12.72 mm). In still other embodiments, a secondary outlet diameter 334-2 may be less than 0.075 in. (1.91 mm) or greater than 1.000 in. (25.40 mm).

In some embodiments, the primary outlet diameter 344-1 of one or more primary fluid outlets 336-1 (and potentially each primary fluid outlet 336-1) may be equal to the secondary outlet diameter 344-2 of one or more secondary fluid outlets 336-2 (and potentially each secondary fluid outlet 336-2). In other embodiments, a primary outlet diameter 344-1 may be greater than a secondary outlet diameter 344-2, or a primary outlet diameter 344-1 may be less than a secondary outlet diameter 344-2. According to at least some embodiments, the outlet diameter may alter the energy with which a fluid is discharged from the fluid outlet. For example, a smaller diameter may provide a higher speed of the fluid at the fluid outlet (such as by the Venturi Principle), thereby increasing the energy of the fluid flow. In other examples, a larger diameter may allow for a greater volume of flow (at the same flow speed), increasing the transport capacity of the fluid to flush debris, cuttings, or other materials from the blade 324 or a cutting element 338.

While the fluid outlets 336 have been described in terms of a diameter, it will be appreciated by those skilled in the art in view of the disclosure herein, that the fluid outlets 336 may not have a constant diameter, or may have other shapes without any diameter. Thus, the outlet diameters 344 may equally apply to fluid outlets 336 having a width (e.g., a square), a height (e.g., a triangle), or other configurations. In some embodiments, such as where a fluid outlet 336 has an elliptical or elongated shape, the dimensions or other features described for an outlet diameter 344 can apply to a major diameter/width, a minor diameter/width, or both a major and minor diameter/width.

In some embodiments, the secondary outlet diameter 344-2 may be at least partially related to the row spacing 346 between rows of cutting elements 338 at the corresponding location of a secondary fluid outlet 336. For example, the secondary outlet diameter 344-2 may be a percentage of the row spacing 346. In some embodiments, the secondary outlet diameter 344-2 may be in a range having an upper value, a lower value, or an upper and lower value, including any of 10%, 20%, 30%, 40%, 50%, 60%, 70%, 80%, 90% or 100%, or any value therebetween of the row spacing 346. For example, the secondary outlet diameter 344-2 may be greater than 10% of the row spacing 346. In other examples, the secondary outlet diameter 344-2 may be less than 100% of the row spacing 346. In yet other examples, the secondary outlet diameter 344-2 may be in a range of 10% to 100% of the row spacing 346. In further examples, the secondary outlet diameter 344-2 may be in a range of 20% to 90% of the row spacing 346. In yet further examples, the secondary outlet diameter 344-2 may be in a range of 30% to 80% of the row spacing 346. In still further examples, the secondary outlet diameter 344-2 may be less than 10% of the row spacing 346.

In some embodiments, a blade 324 may have a variety of values for the primary outlet diameters 344-1 for the primary fluid outlets 336-1. In other embodiments, a blade 324 may have a constant value for the primary outlet diameter 344-1 for the primary fluid outlets 336-1. In some embodiments, a blade 324 may have a variety of values for the secondary outlet diameters 344-2 for the secondary fluid outlets 336-2. In the same or other embodiments, a blade 324 may have a constant value for the secondary outlet diameter 344-2 for the secondary fluid outlets 336-2. For example, the primary outlet diameters 334-1 or the secondary outlet diameters 344-2 may vary depending at least partially upon the work rate of the nearest cutting element 338, the number of cutting elements 338 the fluid outlet 336 serves, and the like.

In some embodiments, the primary outlet diameters 344-1, the secondary outlet diameters 344-2, or both, may be a percentage of a nozzle opening diameter 348. For example, a primary outlet diameter 344-1, a secondary outlet diameter 344-2, or both, may be less than the nozzle opening diameter 348. In other examples, a primary outlet diameter 344-1 or a secondary outlet diameters 344-2 may be less than 90%, 80%, 70%, 60%, 50%, 40%, 30%, or 20% of the nozzle opening diameter 348.

Any or each of the fluid outlets located on the nose region, the shoulder region, or both the nose and shoulder regions of the blade 324 may be positioned an outlet distance 350 from the nearest cutting element 338. The outlet distance 350 is the shortest distance between any portion of the fluid outlet and any portion of a cutting face of a cutting element 338. In some embodiments, the outlet distance 350 may be at defined or described in relation to a cutting face diameter 352 of the cutting elements 338. In some embodiments, an outlet distance 350 may be in a range having an upper value, a lower value, or an upper and lower value including any of 5%, 10%, 25%, 50%, 75%, 100%, 150%, 200%, 250%, 300%, 500%, any value therebetween, or any other percentage, of a cutting face diameter 352. For example, an outlet distance 350 may be greater than 5% of a cutting face diameter 352. In the same or other examples, an outlet distance 350 may be less than or equal to 300% of a cutting face diameter 352 (or triple a cutting face diameter 352). In yet other examples, an outlet distance 350 may be less than or equal to 200% of a cutting face diameter 352 (or double a cutting face diameter 352). In further examples, an outlet distance 350 may be in a range of 5% to 300% or in a range of 50% to 200% of a cutting face diameter 352.

In some embodiments, at least 10% of the cutting elements 338 located on the nose region, the shoulder region, or on both the nose and shoulder regions are positioned relative to a fluid outlet such that an outlet distance 350 of the fluid outlet is less than or equal to 400% of a cutting face diameter 352. In other embodiments, at least 10% of the cutting elements 338 located on the nose region, the shoulder region, or on both the nose and shoulder regions are positioned relative to a fluid outlet such that an outlet distance 350 of the fluid outlet is less than or equal to 300% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 400% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 300% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 400% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 300% of a cutting face diameter 352. In further embodiments, at least 80% of the cutting elements 338 located on the nose region, the shoulder region, or both the nose and the shoulder regions are positioned relative to a fluid outlet such that an outlet distance 350 of the fluid outlet is less than or equal to 400% of a cutting face diameter 352. In some embodiments, at least 80% of the cutting elements 338 located on the nose region, the shoulder region, or both the nose and the shoulder regions are positioned relative to a fluid outlet such that an outlet distance 350 of the fluid outlet is less than or equal to 300% of a cutting face diameter 352.

In some embodiments, at least 10% of the cutting elements 338 located on the nose region, the shoulder region, or on both the nose and shoulder regions are positioned relative to a fluid outlet such that an outlet distance 350 of the fluid outlet is less than or equal to 200% of a cutting face diameter 352. In other embodiments, at least 10% of the cutting elements 338 located on the nose region, the shoulder region, or on both the nose and shoulder regions are positioned relative to a fluid outlet such that an outlet distance 350 of the fluid outlet is less than or equal to 100% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 200% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 100% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 200% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 100% of a cutting face diameter 352. In further embodiments, at least 80% of the cutting elements 338 located on the nose region, the shoulder region, or both the nose and the shoulder regions are positioned relative to a fluid outlet such that an outlet distance 350 of the fluid outlet is less than or equal to 200% of a cutting face diameter 352. In some embodiments, at least 80% of the cutting elements 338 located on the nose region, the shoulder region, or both the nose and the shoulder regions are positioned relative to a fluid outlet such that an outlet distance 350 of the fluid outlet is less than or equal to 100% of a cutting face diameter 352.

In some embodiments, at least 10% of the cutting elements 338 located on the nose region, the shoulder region, or on both the nose and shoulder regions are positioned relative to a fluid outlet such that an outlet distance 350 of the fluid outlet is less than or equal to 500% of a cutting face diameter 352. In other embodiments, at least 10% of the cutting elements 338 located on the nose region, the shoulder region, or on both the nose and shoulder regions are positioned relative to a fluid outlet such that an outlet distance 350 of the fluid outlet is less than or equal to 50% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 500% of a cutting face diameter 352. In other embodiments, at least 50% of the cutting elements 338 located on the nose region, the shoulder region, or both the nose and shoulder regions are positioned relative to a fluid outlet such that an outlet distance 350 of the fluid outlet is less than or equal to 50% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 500% of a cutting face diameter 352. In yet other embodiments, at least 70% of the cutting elements 338 located on the nose region, the shoulder region, or both the nose and shoulder regions are positioned relative to a fluid outlet such that an outlet distance 350 of the fluid outlet is less than or equal to 50% of a cutting face diameter 352. In further embodiments, at least 80% of the cutting elements 338 located on the nose region, the shoulder region, or both the nose and the shoulder regions are positioned relative to a fluid outlet such that an outlet distance 350 of the fluid outlet is less than or equal to 500% of a cutting face diameter 352. In some embodiments, at least 80% of the cutting elements 338 located on the nose region, the shoulder region, or both the nose and the shoulder regions are positioned relative to a fluid outlet such that an outlet distance 350 of the fluid outlet is less than or equal to 50% of a cutting face diameter 352.

In some embodiments, a ratio of the quantity of fluid outlets to the quantity of cutting elements 338 in the respective nose region, shoulder region, or both shoulder and nose regions, may be greater than 1.0 (i.e., more fluid outlets than cutting elements 338). In other embodiments, a ratio of the quantity of fluid outlets to the quantity of cutting elements 338 in the respective nose region, shoulder region, or both shoulder and nose regions of the blade 324 may be less than 1.0 (i.e., less fluid outlets than cutting elements 338). For instance, the ratio may be within a range having an upper value, a lower value, or both upper and lower values including any of 0.05, 0.1, 0.25, 0.35, 0.5, 0.75, 0.85, 0.95, 0.99, or values therebetween. In yet other embodiments, a ratio of the quantity of fluid outlets to the quantity of cutting elements 338 on the respective nose region, shoulder region, or both shoulder and nose regions of the blade 324 may be equal to 1.0.

A blade 324 may have any number of designs. For instance, in some embodiments, a back-up, trailing, or secondary row of cutting elements may generally extend in a row that is about parallel to a row of leading or primary row of cutting elements. As shown in FIG. 4-3, however, in other embodiments, the blade 324 may have other configurations. For instance, in the illustrated embodiment, a leading or primary set/row 343-1 of cutting elements 338 may be trailed by one or more back-up or trailing sets/rows 343-2, 343-3, 343-4. In the illustrated embodiment, row 343-2 may extend in a direction more closely parallel to the primary row 343-1 than rows 343-3, 343-4. Row 343-3 may also extend in a direction more closely parallel to the primary row 343-1 than row 343-4. Indeed, in the illustrated embodiment, the trailing row 343-4 may extend in a direction that is about perpendicular to, or that is between 75° and 105° offset from, the primary row 343-1. As each of the rows 343 may be associated with corresponding fluid outlets 336, the fluid outlets corresponding to each of the rows 343 may, when viewed in the bottom view shown in FIG. 4-3, also follow a similar path. Thus, rows or arrays of secondary fluid outlets 336-2 associated with cutting elements 338 in the trailing rows 343-2, 343-3, 343-4 may have the same or similar angular offsets relative to rows or arrays of primary fluid outlets 336-1 associated with cutting elements 338-1 of the leading row 343-1.

Figures 1, 5:
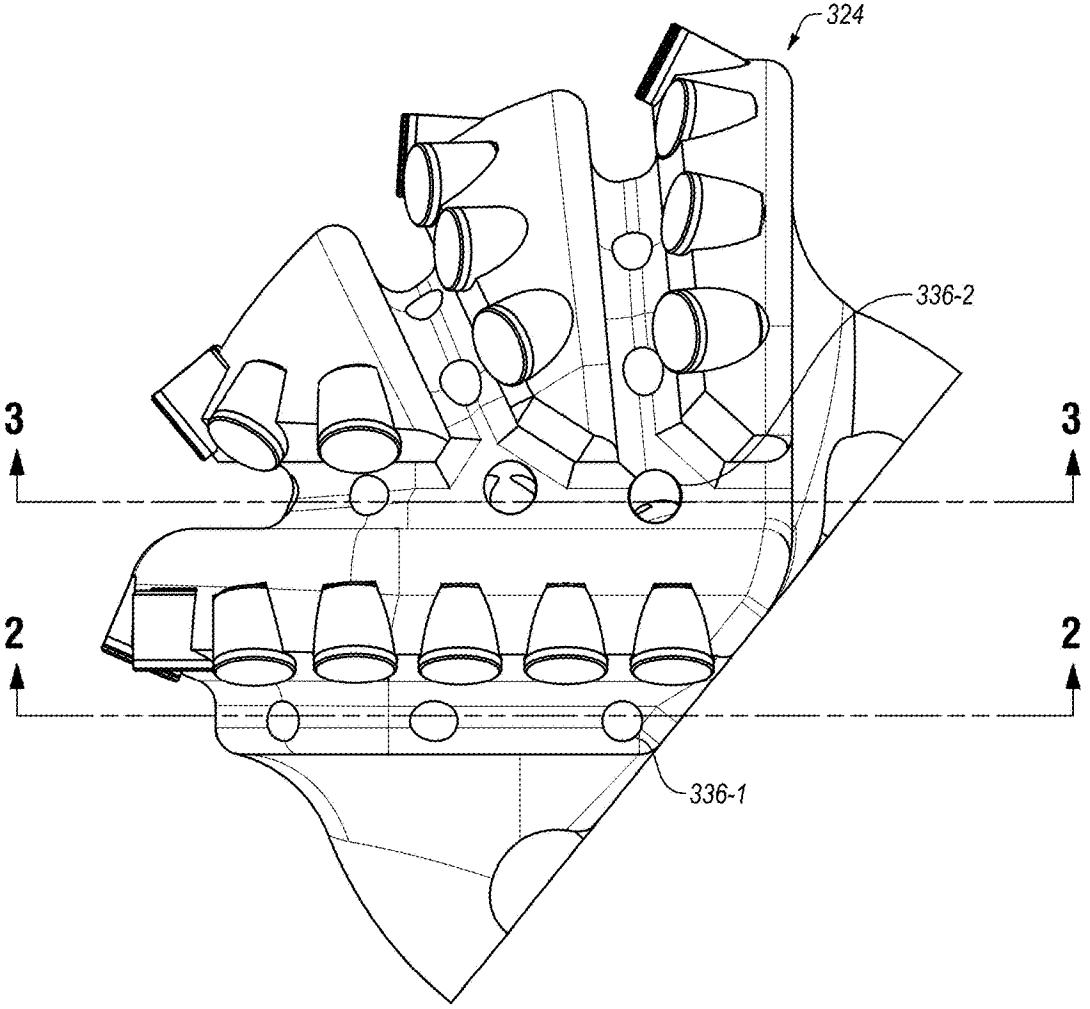
Figures 2, 5:
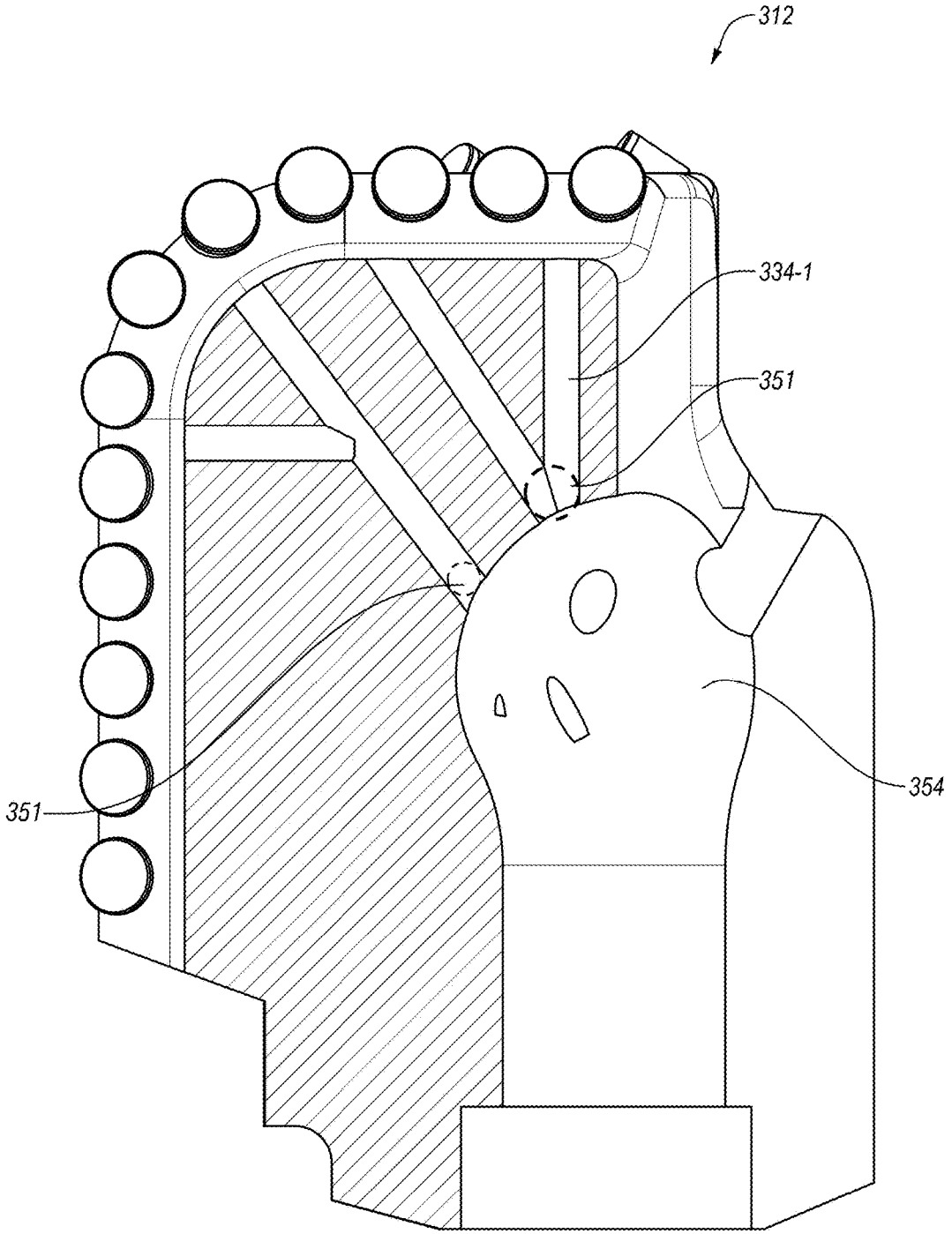
Figures 3, 5:
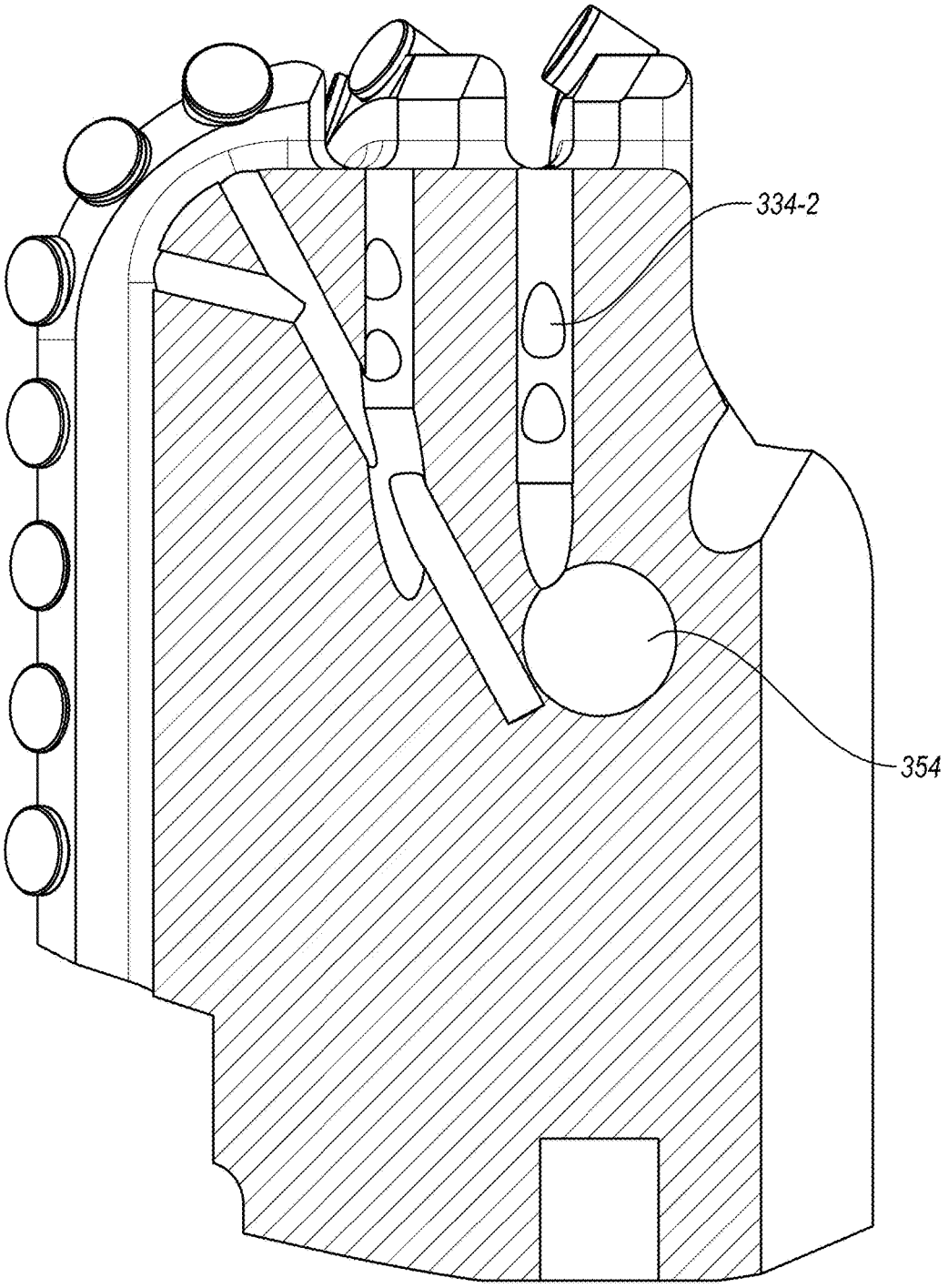

FIG. 5-1 illustrates the embodiment of a blade 324 of FIG. 4-1 through 4-3 without the bit body. The primary fluid outlets 336-1 may be positioned in a row on the blade 324. The secondary fluid outlets 336-2 may be positioned in a row on the blade 324. FIG. 5-2 illustrates a cross-section through the row of primary fluid outlets 336-1 and FIG. 5-3 illustrates a cross-section through the row of secondary fluid outlets 336-2.

Fluid conduits (such as described in relation to FIG. 2) may branch from a chamber or primary conduit within a bit, or may be singular to limit or even prevent loss of energy or fluid pressure between the chamber or primary conduit. As shown in FIG. 5-2 (taken along line 2-2 of FIG. 5-1), in some embodiments, a fluid conduit may be a singular cooling or fluid conduit 334-1 extending from a fluid reservoir 354 within the bit 312. The fluid reservoir 354 may be a fluid head from which fluid is dispersed in the bit 312, and may not hold or store any fluid. In some embodiments, the fluid reservoir 354 may be the chamber 130 described in relation to FIG. 2. In other embodiments, at least part of the fluid reservoir 354 may be round, such as a sphere or an ellipsoid, or a hemispherical or semi-ellipsoid volume as shown in FIG. 5-2. A fluid reservoir that is at least partially round (e.g., at a downhole end portion) may reduce energy loss to turbulence of the fluid flow and limit or even prevent internal erosion that may occur in a more conventional crowfoot chamber design having a generally flat downhole end surface, as shown in FIG. 2. In other embodiments, the fluid reservoir 354 may be the primary conduit 132 described in relation to FIG. 2. In yet other embodiments, the fluid reservoir 354 may be the central conduit 128 described in relation to FIG. 2. As shown in FIG. 5-3 (taken along line 3-3 in FIG. 5-1), in some embodiments, a fluid conduit may be a branching cooling or fluid conduit 334-2 that includes multiple branching conduits between a fluid reservoir 354 to deliver and discharge a fluid therein. While FIGS. 5-2 and 5-3 illustrate cooling, cleaning, lubricating, or other fluid conduits 334-1, 334-2 (collectively fluid conduits 334) as extending in a generally linear direction from the fluid reservoir 354 and potentially to fluid outlets on the blade 324 (e.g., fluid outlets 336-1 and 336-2 of FIGS. 4-3), and as having a generally constant cross-sectional area/profile, the fluid conduits 334 may follow any number of paths and have any number of configurations. For instance, a fluid conduit 334 may follow a curved or tortious path, or have a variable cross-sectional area. Such shapes and configurations, particularly in connection with a large number of fluid conduits 334, may be difficult and impractical, if not impossible, to manufacture using conventional mold operations in which sand displacements are used to define fluid paths. However, using three-dimensional printing or additive manufacturing processes to print/form the bit, complex fluid conduits 334 may be formed.

In some embodiments, the fluid conduits 334 may be used to provide customized hydraulics that may be modified at a rig, in a servicing location, or at a manufacturing center, or any other location. In FIG. 5-2, for instance, illustrates example obstruction devices, such as balls 351 (shown in dashed lines) which may be inserted into the bit 312 through a shank of the bit 312. The balls 351 may be dropped into a bore of the bit 312, and conveyed into corresponding fluid conduits 334. In some embodiments, magnets or other devices may facilitate positioning of the balls 351. The balls 351 can set in the fluid conduits 334 and obstruct the flow of fluid therein. As the bit is moved into the wellbore and used in a drilling operation, the balls 351 or other obstruction devices may restrict, or even prevent fluid from flowing to one or more fluid outlets. To remove the balls 351, the bit may be turned with the bit face up (i.e., as shown in FIG. 5-2). Optionally, a rod may be inserted through a fluid outlet and extended through fluid conduits 334 to push against the balls 351 to remove them. Based on the positioning of the balls 351, an operator can effectively decide which fluid outlets to turn on or off for a particular application or operation.

Figures 1, 6:
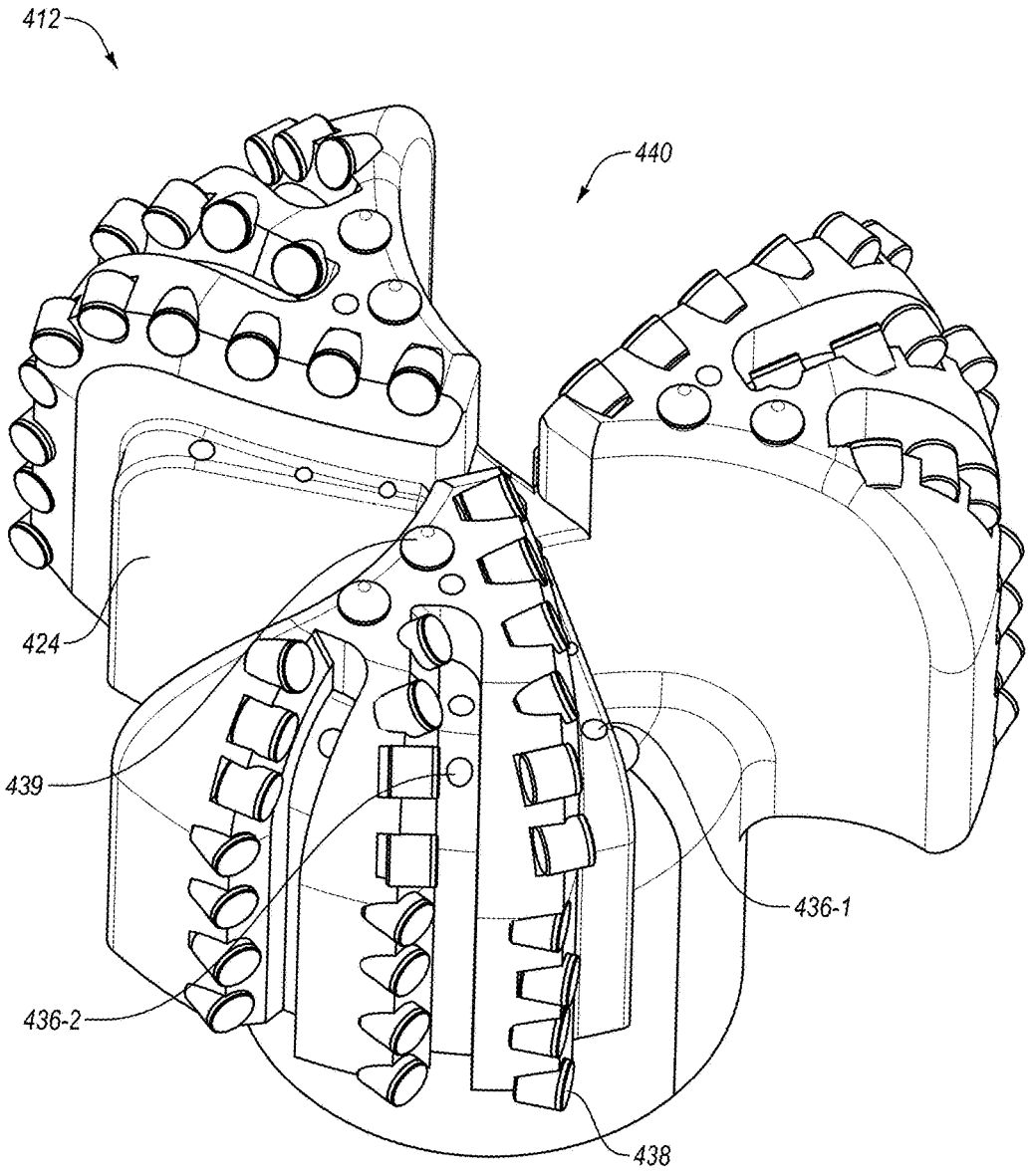
Figures 2, 6:
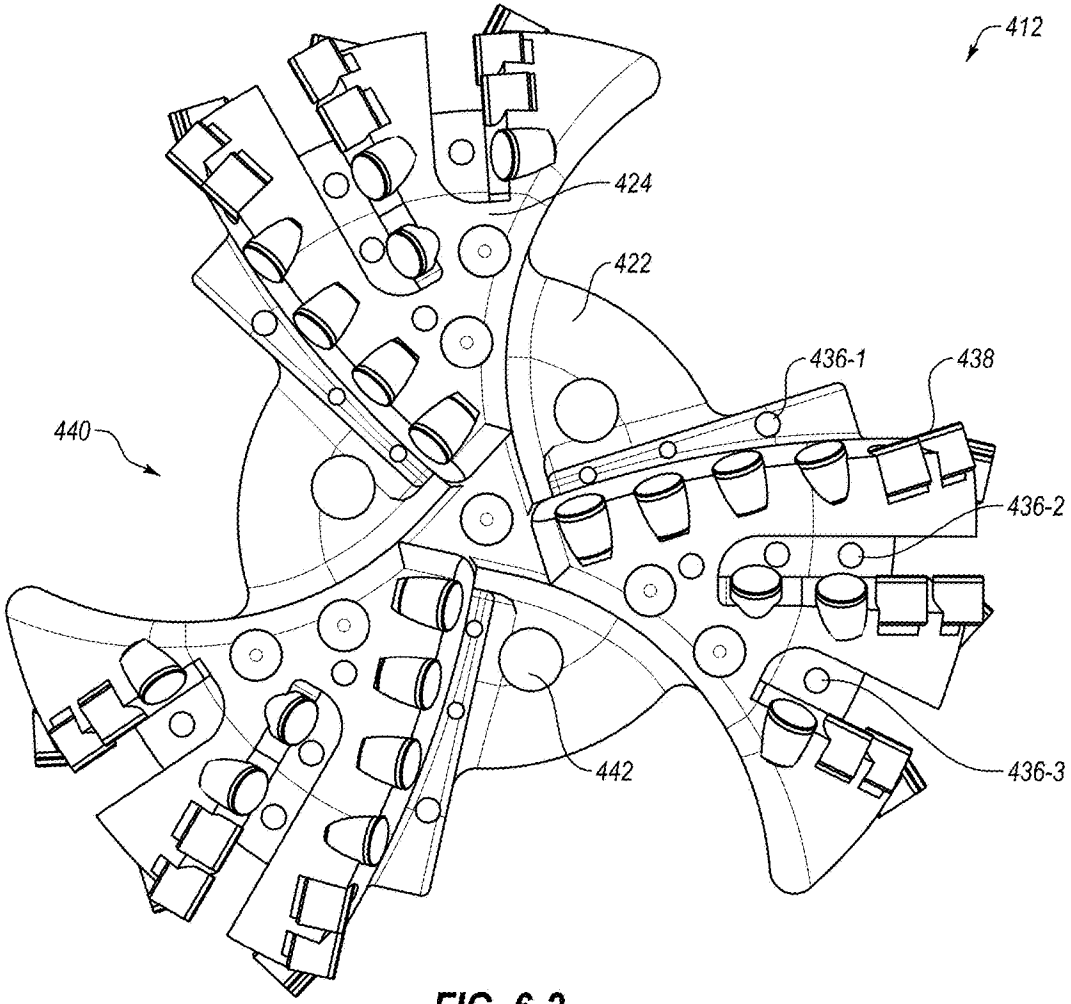

FIGS. 6-1 and 6-2 illustrate yet another embodiment of a bit 412 according to some embodiments of the present disclosure. The bit 412 may have three blades 424 with a junk slot 440 positioned angularly between each pair of blades 424. The blades 424 may have cutting elements 438 positioned thereon with primary fluid outlets 436-1 positioned on the rotationally leading edge of the blades 424. The blades 424 may have secondary fluid outlets 436-2 positioned on the blades 424 rotationally behind the primary row of cutting elements 438 and primary fluid outlets 436-1. In the embodiment shown in FIG. 6-1, some of the fluid outlets 436 may be recessed relative to a surface having a pocket therein, and recessed relative to corresponding cutting elements 438, and faces of the cutting elements 438, to which they provide cooling, cleaning, lubricating, or other fluid. Other fluid outlets 436 may be formed in the same surface into which a pocket of a corresponding cutting element is positioned.

While cutting elements (e.g., cutting elements 438) described herein may include shear cutting elements having a flat or planar cutting surface, with a cutting edge that cuts formation or another workpiece by applying shear forces, the disclosure is not limited to any particular type of cutting element. For instance, FIG. 6-1 illustrates that at least some cutting elements 439 may be non-planar. Example non-planar cutting elements may include cutting elements having conical, frusto-conical, ridged, domed, other three-dimensional shaped cutting faces, or combinations of the foregoing. Moreover, non-planar cutting elements may be used in a nose, shoulder, or gage region of a bit (or any combination thereof), and may be combined with planar cutting elements or different types of non-planar cutting elements.

FIG. 6-2 is a bottom view of the embodiment of the bit 412. The bit 412 may have one or more nozzle openings 442 positioned in a bit body 422. In the same or other embodiments, one or more nozzle openings 442 may be located on a blade 424. The blade 424 may have secondary fluid outlets 436-2 positioned on the blades 424 rotationally behind the primary row of cutting elements 438 and primary fluid outlets 436-1 and behind the secondary row of cutting elements 438 with one or more additional secondary fluid outlets 436-3 providing fluid for cooling, cleaning, or lubrication to a tertiary row of cutting elements 438. In the illustrated embodiment, the primary, secondary, and tertiary rows of cutting elements 438 may be on the same blade 424, and optionally extend from the gage of the bit 412 to different positions relative to a central axis of the bit 412. For instance, the primary row of cutting elements 438 may extend to a radial position nearest the axis of the bit 412, and the secondary row of cutting elements 438 may extend to a radial position nearer the axis of the bit 412 than the tertiary row of cutting elements 438. Similarly, the primary fluid outlets 436-1 may be in one or more rows or arrays that extend nearer the axis of the bit 412 than the secondary fluid outlets 436-2 associated with the secondary row of cutting elements 438, which in turn may extend nearer the axis of the bit 412 than the secondary fluid outlets 436-3 associated with the tertiary row of cutting elements 438.

Figure 7:
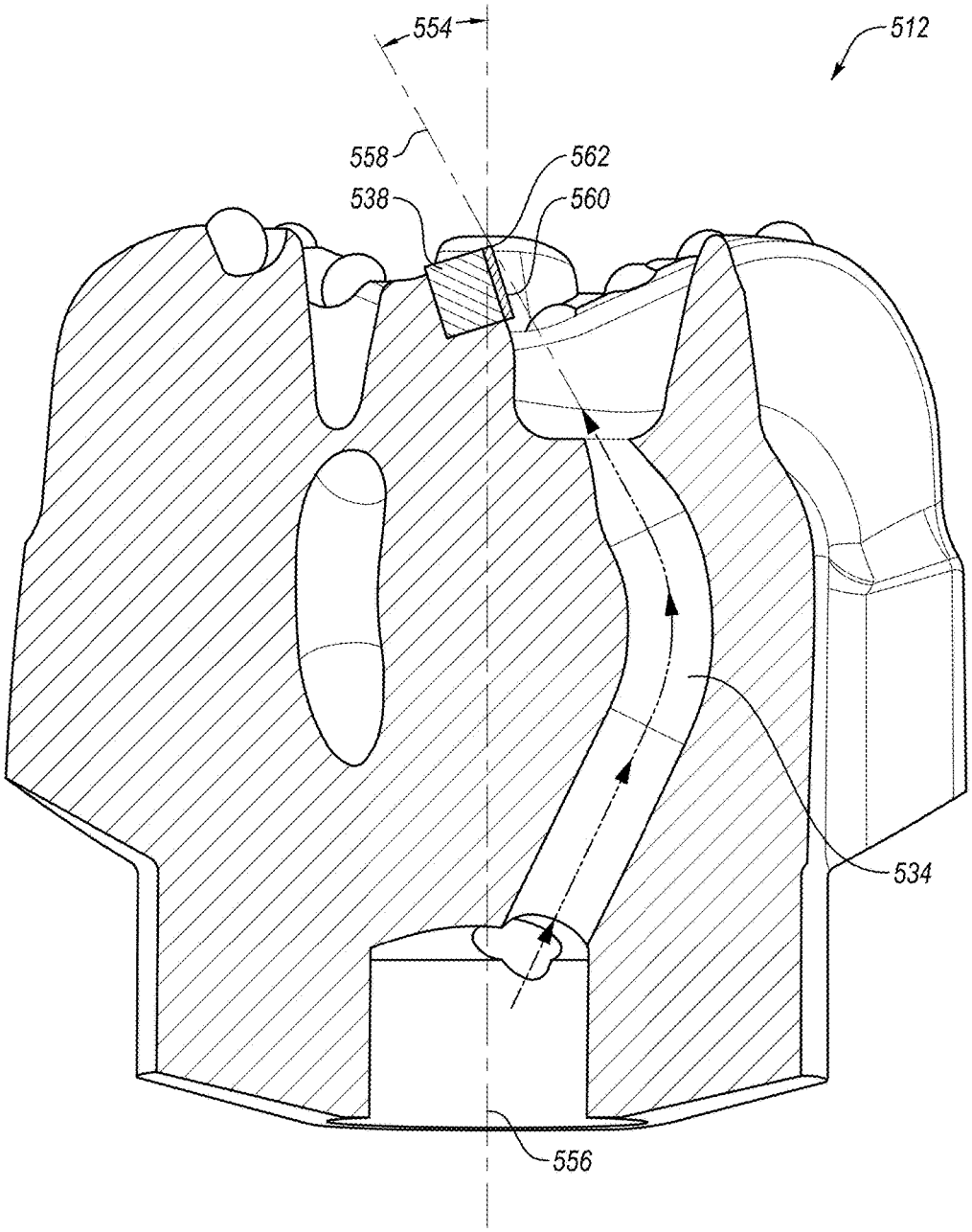
FIG. 7 is a side cross-sectional view of a bit, according to further embodiments of the present disclosure.

FIG. 7 illustrates yet another bit 512 according to some embodiments of the present disclosure. The bit 512 may have a cooling or other fluid conduit 534 having a non-linear path. For example, the fluid conduit 534 may have a curved path. A fluid conduit 534 that is at least partially curved may reduce energy loss to turbulence of the fluid flow and limit, or potentially prevent, internal erosion. A fluid conduit 534 that is at least partially curved may provide smaller overall dimensions of the fluid conduit 534 in an axial or radial direction (or in both axial and radial directions), allowing for greater design flexibility in bit design. In other examples, the fluid conduit 534 may have a path with a discontinuous angle. In some embodiments, a non-linear fluid conduit 534 may allow the fluid conduit 534 to discharge a drilling fluid in a fluid path 558 extending across or toward a cutting face 560 of a cutting element 538. In some embodiments, the fluid path 558 may cause fluid in the direction of flow to engage at least a portion of a cutting face 560 of the cutting element 538. For example, the fluid path 558 may be directed to intersect with the cutting face 560. In at least one embodiment, the fluid path 558 may be directed to intersect with or contact a cutting edge 562 (or cutting tip) of the cutting face 560.

In accordance with some embodiments of the present disclosure, the fluid path 558 may form a nonzero fluid path angle 554 with a rotational axis 556 of the bit 512 relative to the rotational direction of the bit 512. In some embodiments, the fluid path 558 may be about parallel to the cutting face 560 (to direct fluid flow across the cutting face 560 rather than at a particular portion of the cutting face 560), although in other embodiments, such as that shown in FIG. 7, the fluid path 558 may be non-parallel with the cutting face 560. In some embodiments, the cutting face 560 of the cutting element 538 may be oriented in the rotational direction of the bit 512 and the fluid path 558 may be oriented to direct fluid onto the cutting face 560. In some embodiments, the fluid path angle 554 may be in a range having an upper value, a lower value, or an upper and lower value including any of 0°, 1°, 5°, 10°, 20°, 30°, 40°, 50°, 60°, 70°, 80°, 90°, or any values therebetween. For example, the fluid path angle 554 may be greater than 1°. In other examples, the fluid path angle 554 may be less than 90°. In yet other examples, the fluid path angle 554 may be between 1° and 60°, or between 5° and 55°. In further examples, the fluid path angle 554 may be between 10° and 50°. In yet further examples, the fluid path angle 554 may be between 20° and 40°. In FIG. 7, for instance, the fluid path angle 554 is about 30°.

In some embodiments, the angular offset between the fluid path 558 and the cutting face 560 (e.g., a planar cutting face) may be in a range having an upper value, a lower value, or an upper and lower value including any of 0°, 1°, 5°, 10°, 20°, 30°, 40°, 50°, 60°, 70°, 80°, 90°, or any values therebetween. For example, the fluid path 558 may extend at an angle that is 0° offset from the cutting face 560 (i.e., is directly across the cutting face 560), that is at least 1° offset from the cutting face 560, that is less than 90° offset from the cutting face 560, or that is 90° offset from the cutting face 560 (i.e., is directly into the cutting face 560). In other examples, the fluid path 558 may be between 1° and 60°, between 5° and 55°, between 10° and 50°, or between 20° and 40° offset from the cutting face 560. In FIG. 7, for instance, the fluid path 558 is about 10° offset from the cutting face 560.

In some embodiments, the fluid conduit 534 may taper to decrease at or near the exit of the fluid conduit 534 toward the cutting element 538. A decreasing taper may, for example, accelerate the fluid within the fluid conduit 534. In some embodiments, the fluid conduit 534 may taper to reduce the flow area of the fluid conduit 534 by a percentage that is in a range having an upper value, a lower value, or an upper and lower value including any of 1%, 5%, 10%, 20%, 30%, 40%, 50%, 60%, 70%, 80%, 90%, or any values therebetween. For example, the fluid conduit 534 may taper by a percentage of a flow area of the fluid conduit 534 that is greater than 1%, that is less than 90%, that is between 10% and 80%, that is between 20% and 70%, or that is between 30% and 60%.

In other embodiments, the fluid conduit 534 may taper to widen at or near the exit of the fluid conduit 534 toward the cutting element 538. A widening exit may, for example, spread the fluid more broadly upon exit from the fluid conduit 534. In some embodiments, the fluid conduit 534 may widen by a percentage of a flow area of the fluid conduit 534 that is in a range having an upper value, a lower value, or an upper and lower value including any of 1%, 5%, 10%, 20%, 30%, 40%, 50%, 60%, 70%, 80%, 90%, or any values therebetween. For example, the fluid conduit 534 may widen by a percentage of a flow area of the fluid conduit 534 that is greater than 1%, that is less than 90%, that is between 10% and 80%, that is between 20% and 70%, or that is between 30% and 60%. In some embodiments, the fluid conduit 534 may widen in one or more dimensions and while decreasing in one or more other dimensions, or may widen or decrease by a greater extent in one dimension than in another dimension, thereby changing a cross-sectional shape of the fluid conduit 534.

In some embodiments, the fluid conduits 534 may lead to nozzles in one or more junk slots. In some embodiments, the fluid conduits 534 may lead to fluid outlets on one or more blades. Thus, the description of the fluid conduits 534, including their dimensions, directions, flow paths to or across cutting elements, and the like, may be applied to each other embodiment disclosed herein.

Figure 8:
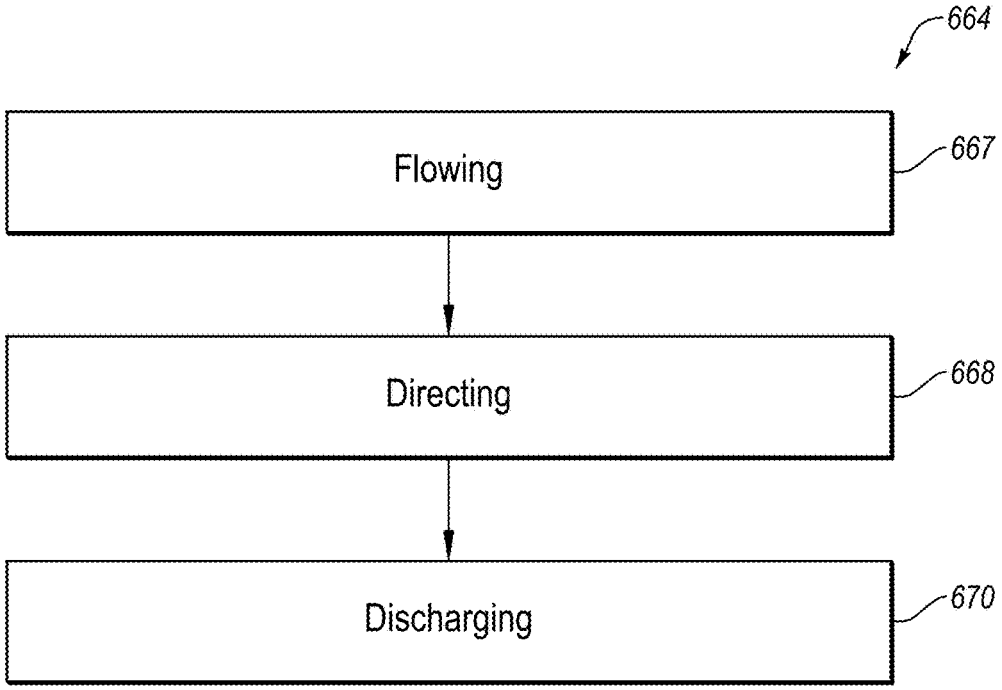
FIG. 8 is a flowchart of a method of removing material with a bit, according to some embodiments of the present disclosure.

As shown in FIG. 8, a method 664 of removing material with a bit includes flowing 667 a fluid through a bit. The method 664 further includes directing 668 the fluid and/or a fluid path out of a bit. In some embodiments, the method 664 may further include discharging 670 the fluid along a fluid path along any combination of out a fluid outlet in a blade, across a cutting face of a cutting element, or at a cutting element (e.g., at a cutting portion such as a cutting edge or cutting tip). In some embodiments, discharging 670 may further include cooling, cleaning, or lubricating at least a part of the cutting face of the cutting element with the fluid and/or fluid path (e.g., by contacting the cutting face with the fluid). In at least one embodiment, directing 668 or discharging 670 may include accelerating the fluid through at least a portion of a bit (e.g., within or through a fluid conduit). Accelerating the fluid may increase the energy of the fluid to improve cooling, flushing, deballing, or combinations thereof at the face or other portion of the cutting element. In some embodiments, the method 664 may include one or more of the techniques, processes, apparatus, or other features described herein, in any combination.

In at least some embodiments, a bit having a system of fluid conduits and fluid outlets according to the present disclosure may cool, clean, or lubricate a cutting elements more efficiently and effectively than a conventional bit. The cutting elements may experience an extended operational lifetime due at least partially to the improved cooling, cleaning, or lubrication, which may, in turn, increase run time and efficiency of a drilling system.

Drill bits and other tools having fluid outlets in a blade, fluid conduits leading to a blade, individual fluid outlets for each cutting element (or for groups of cutting elements), fluid conduits directing fluid along a fluid path at or across a cutting element, and other features of the present disclosure may be provided by additive manufacturing techniques. Example techniques may include depositing a composition layer-by-layer into the three-dimensional structure of the cutting tool, where the material composition of each layer is selected and shaped to provide the fluid conduit and fluid outlet positions at each deposition layer level. Methods of depositing a material composition according to embodiments of the present disclosure may use an additive manufacturing deposition device, where each layer may be deposited by one or more feeders from the deposition device.

The material composition of each layer, as well as the physical design parameters of each layer (e.g., shape of the outer perimeter of each layer, area of each layer, thickness of each layer, voids where fluid conduits are located, etc.), may be designed prior to deposition using a software modeling program, such as a computer aided design ("CAD") system. For example, according to embodiments of the present disclosure, a method of making a cutting tool may include modeling the cutting tool using a software modeling program. The modeled cutting tool may have a designed composition and physical structure (such as internal fluid conduit paths and locations, general sizes and shapes, etc.). The cutting tool can be divided into multiple planes, and the composition and structure of the planes can be specified for a particular plane, or for locations within a plane (e.g., mapped into grid patterns). Each layer deposited during the deposition process can be used to build the three dimensional cutting tool body.

Figure 9:
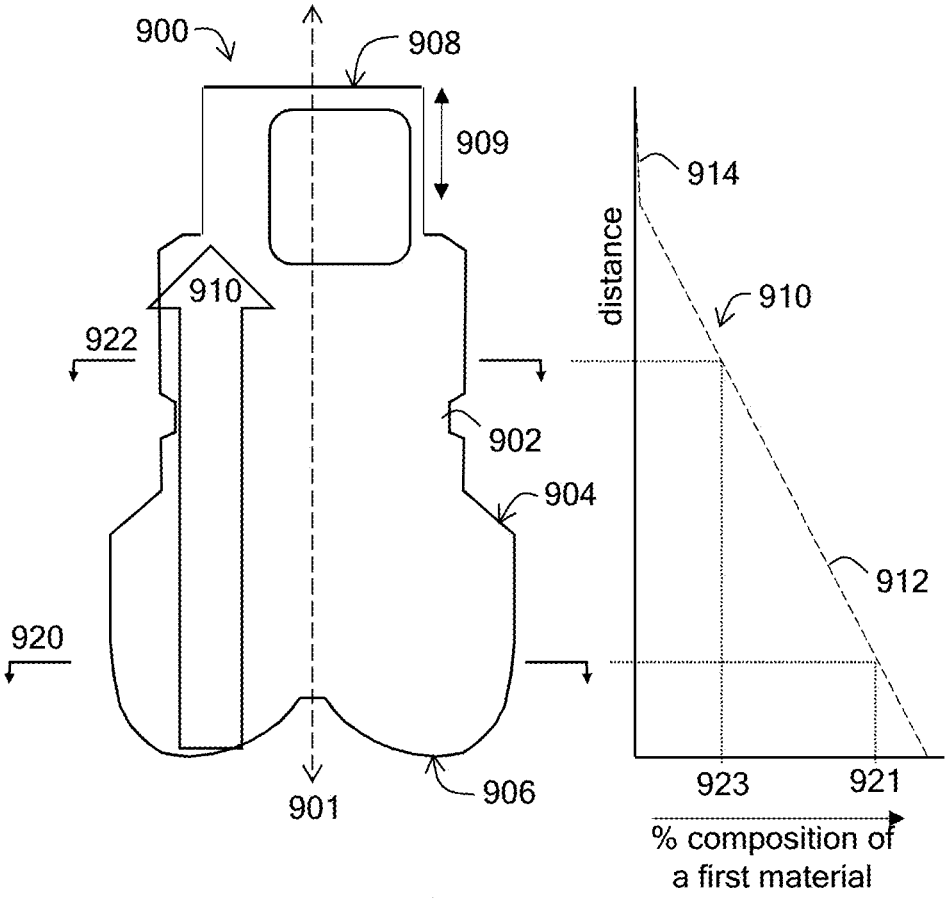
FIG. 9 is a cross-sectional, schematic view of a downhole cutting tool having a gradient composition, according to some embodiments of the present disclosure.

FIG. 9, for instance, shows a diagram of a cutting tool model and a graph of the gradient composition design of the cutting tool model, according to some embodiments of the present disclosure. As shown, the cutting tool is a drill bit 900 that includes a body 902 having a plurality of blades 904 extending outwardly from the body and forming the cutting end 906 of the drill bit 900. A connection end 908 is opposite the cutting end 906, and a longitudinal axis 901 extends axially through the body 902. The composition design of the drill bit 900 (or drill bit model when programmed or designed) includes an axial gradient 910 having a gradually changing amount of a first material in the composition along a first distance from the cutting end 906. The first gradient composition may form at least the cutting end portion of the body 902 and, in some embodiments, may extend to a connection end portion of the body 902.

The axial gradient 910 may include a first gradient portion having a first compositional slope 912 over a first portion (e.g., the cutting end portion 906 and a shank portion of the bit 900) of the distance of the axial gradient 910. A second gradient portion may have a second compositional slope 914 over a second portion of the distance of the axial gradient 910 (e.g., extending over a connection end portion 909 of the body, or the connection end portion 909 extending an axial distance from the connection end 908). The first compositional slope 912 may be different from the second compositional slope 914. For example, as shown, the second compositional slope 914 may include a relatively steep slope having very little or no change in composition over the connection end portion 909 of the cutting tool, for example, having less than 5 wt % or less than 1 wt % change in composition over the connection end portion 909 of the cutting tool, whereas the first compositional slope 912 may include a relatively shallow slope having a relatively larger percent change in composition over the first portion of the axial gradient distance (e.g., the cutting end and shank portions of the cutting tool).

In some embodiments, the first compositional slope 912 may include a continuously and gradually decreasing amount of erosion resistant material in the composition from the cutting end to the second compositional slope 914 (e.g., ranging from up to 90 wt % or 95 wt % of an erosion resistant material in the composition at the cutting end 906 to about 30 wt %, 20 wt %, 10 wt %, or less of the erosion resistant material (e.g., carbide, ceramic, etc.) in the composition at a portion of the cutting tool between the shank portion and the connection end portion 908 of the cutting tool 900. The second compositional slope 914 may include a composition having a substantial majority (or entire) composition of a relatively softer or more machinable metallic material suitable for machining (e.g., steel, tungsten, etc.). In some embodiments, a compositional slope may be undefined (x=0), where the composition may not change over a selected portion of the cutting tool. For example, in some embodiments, a connection end portion 909 of a cutting tool 900 may be printed or otherwise formed as having a uniform composition of steel, tungsten, or relatively more machinable metallic matrix material suitable for machining and/or welding to a connection piece.

A connection end portion 909 of a cutting tool 900 may include the portion of the cutting tool extending an axial distance from the cutting end ranging from, for example, about 1 in. (2.5 cm), 2 in. (5.1 cm), 4 in. (10.2 cm), or 6 in. (15.2 cm), depending on the overall size of the cutting tool 900. In some embodiments, the connection end portion 909 may be greater than 6 in. (15.2 cm) in length. In some embodiments, a cutting end portion 909 may include the portion of the cutting tool 900 extending an axial distance from the cutting end 906 ranging up to 5%, 10%, 20%, 30%, 50%, or 70% of the total axial length of the cutting tool 900.

The drill bit 900 (or drill bit model) may be divided into a plurality of thin cross-sectional, two-dimensional planes, and one or more compositions may be mapped to each plane. For instance, for a two-dimensional gradient such as the gradient shown in FIG. 9 (where the gradient changes in a single axial direction, but not in a radial direction), each plane may have a single composition, and the same composition may be used for a single plane (or for a few planes), before changing to another composition that is also constant for the next plane. In other embodiments, the composition may vary within a plane. In some embodiments, the compositions of the drill bit 900 may be graphed or mapped as a function of axial distance along the drill bit 900, where the composition 921 at the first axial location 920 may be different from the composition 923 at the second axial location 922, and where the difference between the first composition 921 and the second composition 923 corresponds to the designed first compositional slope 912. While the composition may vary uniformly across the length of at least a portion of the drill bit 900, in other embodiments, the composition mapped to the drill bit 900 may be varied (non-uniform) across two or more planes, such that multiple gradient compositions may be formed axially through the drill bit 900 (where different axial gradient compositions may be formed in different radial positions of the drill bit according to the radial positions of the varied composition across the two or more grid patterns).

According to embodiments of the present disclosure, a method of manufacturing a drill bit may include providing a model of the drill bit 900, dividing the model into multiple planes, mapping a composition to each of the planes (or to cells or grids within each plane), and successively depositing a volume of the composition using a deposition device according to each mapped composition, in sequential layers to build a three dimensional body of the drill bit.

Figure 10:
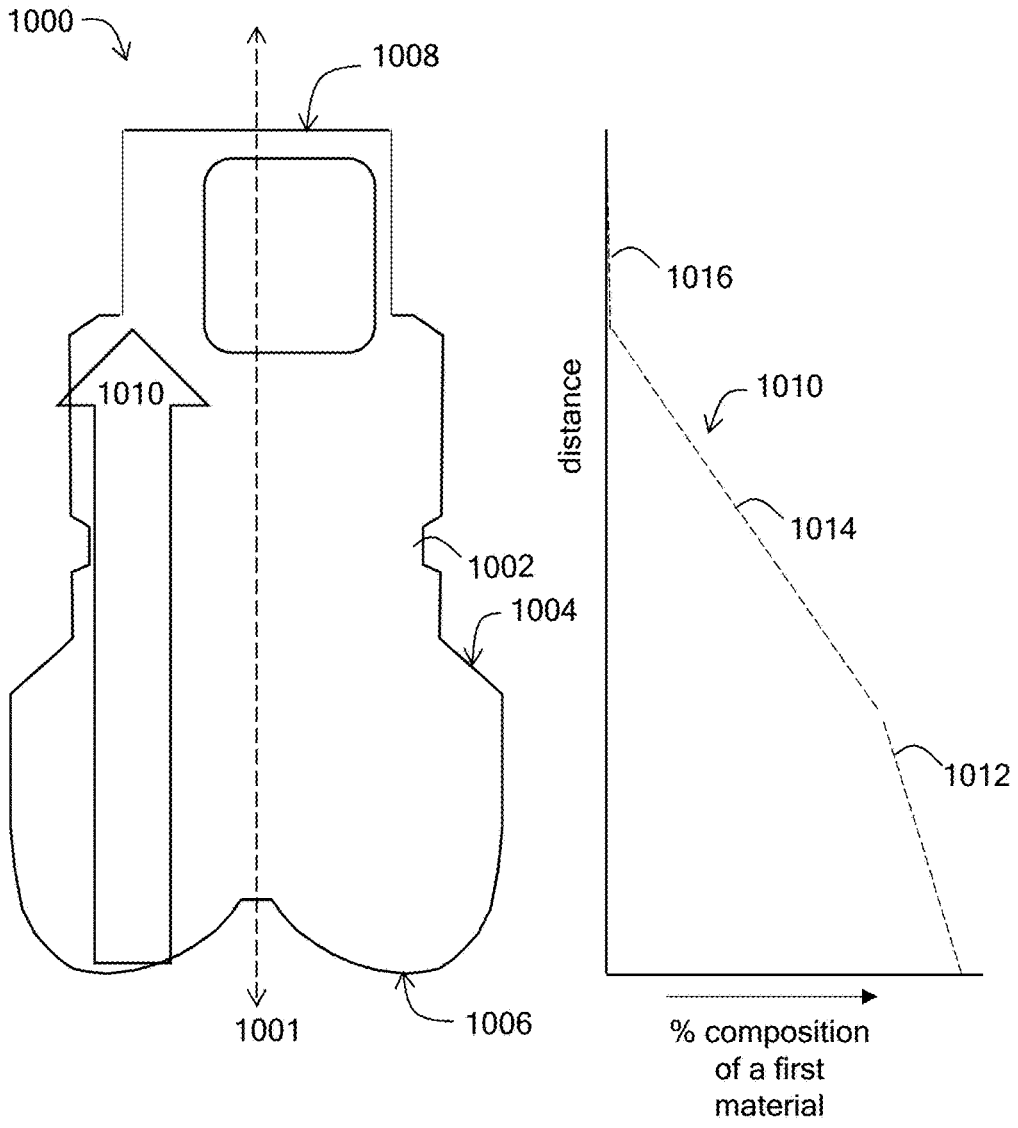
FIG. 10 is a cross-sectional, schematic view of a downhole cutting tool having a gradient composition, according to additional embodiments of the present disclosure.

While the cutting portion of a drill bit may have a generally constant slope to the composition, in other embodiments, the composition may vary in other manners. FIG. 10, for instance, shows a diagram of a cutting tool 1000 having a gradient composition design graphed along a cross-sectional view of the cutting tool. As shown, the cutting tool 1000 is a drill bit including a body 1002 having a plurality of blades 1004 extending outwardly from the body 1002 and forming the cutting end 1006 of the drill bit. A connection end 1008 is opposite the cutting end 1006, and a longitudinal axis 1001 extends axially through the body 1002. The composition design of the cutting tool 1000 includes an axial gradient 1010 having a gradually changing amount of a first material in the composition along a first distance from the cutting end 1006. The first gradient composition may form at least the cutting end portion 1006 of the body 702 and, in some embodiments, may extend to a connection end portion of the body 702.

According to embodiments of the present disclosure, gradient compositions may include a constant compositional slope along the entire gradient. In some embodiments, a gradient composition may include multiple gradient portions at different regions, or which form different regions, of the cutting tool, where adjacent gradient portions have different compositional slopes. In some embodiments, a gradient composition may include one or more stepped changes in gradient compositional slope. FIG. 10 shows an example of an embodiment having a gradient composition including multiple gradient portions forming different regions of the cutting tool 1000, where adjacent gradient portions have different compositional slopes. As shown, the axial gradient 1010 may include a first gradient portion having a first compositional slope 1012 over a first portion (e.g., the cutting end portion) of the length of the cutting tool 1000, and a second gradient portion having a second compositional slope 1014 over a second portion of the length of the cutting tool 1000. The axial gradient 1010 may further include a third compositional slope 1016 over a third portion of the length of the cutting tool 1000. The first compositional slope 1012 may be different from the second compositional slope 1014, and the third compositional slope 1016 may be different from the second compositional slope 1014 and equal to or different than the first compositional slope 1012. While three portions of the drill bit 1000 are shown having different slopes 1012, 1014, and 1016 relative to an adjacent portion, in other embodiments, the axial gradient 1010 may have more than three different slopes or other gradient or varied compositional portions.

The compositional slopes 1012, 1014, 1016 of the axial gradient 1010 may be defined over the same interval of the total gradient distance (or cutting tool length), where different compositional slopes correspond to different rates of changes in percent composition of a first material in the composition. In other words, the rate of change by percent composition of at least a first material in the composition differs as compared to an adjacent portion. In some embodiments, the compositional slope of a gradient portion may be defined as the distance the gradient portion extends over a difference in percent composition of at least a first material in the composition from one end to the other of the gradient portion.

In some embodiments, a gradient composition extending axially through a cutting tool may have a first gradient portion having a first compositional slope extending a first distance of the gradient composition through a cutting end portion of the cutting tool, extending the axial length of the cutting tool from an axially lowermost portion of the cutting tool (e.g., a blade profile nose) through the entire axial length of the cutting profile of the cutting tool (e.g., to a gage portion of a blade profile). In some embodiments, a first gradient portion of the composition forming the cutting end of a cutting tool may have an amount of an erosion resistant material, such as tungsten carbide, in the composition ranging from about 90 wt % to about 60 wt % as an upper limit of the first gradient portion positioned at a first end of the first gradient portion (e.g., at the axially lowermost portion of the cutting tool) to about 60 wt % to about 30 wt % as a lower limit of the first gradient portion positioned at an opposite end of the first gradient portion (e.g., in a gage region of the cutting tool). A gradient composition may further include a second gradient portion extending from the first gradient portion through a shank portion of the cutting tool, the second gradient portion having a second compositional slope over a second distance. In some embodiments, a gradient composition may include more than two gradient portions having different compositional slopes extending partial axial lengths along a cutting tool.

In the embodiment shown in FIG. 10, the gradient composition includes a first gradient portion having the first compositional slope 1012 and forming a cutting end portion of the cutting tool 1000. The cutting end gradient may have a compositional slope 1012 that is steeper (less change in composition of the first material over the same length) than an adjacent gradient portion having the second compositional slope 1014. For example, the cutting end gradient may have an amount of an erosion resistant material (e.g., tungsten carbide) within a range having a lower limit, an upper limit, or lower and upper limits including any of 20 wt %, 30 wt %, 40 wt %, 50 wt %, 60 wt %, 70 wt %, 80 wt %, 90 wt %, 95 wt %, 99 wt %, or values therebetween. A composition having the upper limit of the compositional range may form the nose region of the drill bit and the composition having the lower limit of the compositional range may form a portion of a shoulder or gage region of the drill bit.

The gradient composition design shown in FIG. 10 further includes a second gradient portion having a second compositional slope 1014, which may extend an axial distance along, for example, the shank of the drill bit and between the first gradient portion and a connection end portion. The second gradient portion may have an amount of an erosion resistant material (e.g., tungsten carbide) within a range including a lower limit, an upper limit, or lower and upper limits including any of 0 wt %, 10 wt %, 20 wt %, 30 wt %, 40 wt %, 50 wt %, 60 wt %, 70 wt %, 80 wt %, and values therebetween. In other embodiments, the lower or upper limit may be greater than 80 wt %.

The gradient composition design shown in FIG. 10 further includes a third gradient portion having a third compositional slope 1016 and forming the connection end portion of the cutting tool 1000. The connection end gradient optionally has a compositional slope 1016 that is steeper (less change in composition of the first material over an equal distance) than the adjacent gradient portion having the second compositional slope 1014, and optionally the gradient portion having the first compositional slope 1012. For example, the connection end gradient may have an amount of an erosion resistant material (e.g., tungsten carbide) within a range including a lower limit, an upper limit, or lower and upper limits including any of 0 wt %, 10 wt %, 20 wt %, 30 wt %, 40 wt %, 50 wt %, and values therebetween. In other embodiments, the lower or upper limit may be greater than 50 wt %.

In some embodiments, rather than having a gradient composition, a connection end portion of a cutting tool may have a uniform composition including API rated connection end material, such as API rated steel. The connection end portion of the cutting tool may be machined to form a connection (which may be used to connect the cutting tool to a drill string, for example), or the final geometry of a connection end may be formed by the additive manufacturing process to meet API specifications. Further, in some embodiments, rather than printing the connection end of a cutting tool in the additive manufacturing process to form the cutting tool and connection end as a single piece, a cutting tool body may be formed according to embodiments disclosed herein with a connection end that may be welded or mechanically attached to a separate connection piece, where the separate connection piece may connect the cutting tool to a drill string, for example.

In some embodiments, the gradient composition may include gradually decreasing amounts of tungsten carbide or other wear or erosion resistant materials, and increasing amounts of steel from a cutting end portion of a cutting tool to connection end portion of the cutting tool to provide the cutting end portion with greater erosion resistance. In some embodiments, differing types and/or sizes of tungsten carbide or other erosion resistant material (e.g., carbides or borides) may be deposited at an interval to form a gradient composition having an erosion resistance gradient (i.e., a gradient in the erosion resistance of the composition), where relatively higher erosion resistant compositions may be located in a cutting end portion of a cutting tool.

Figure 11:
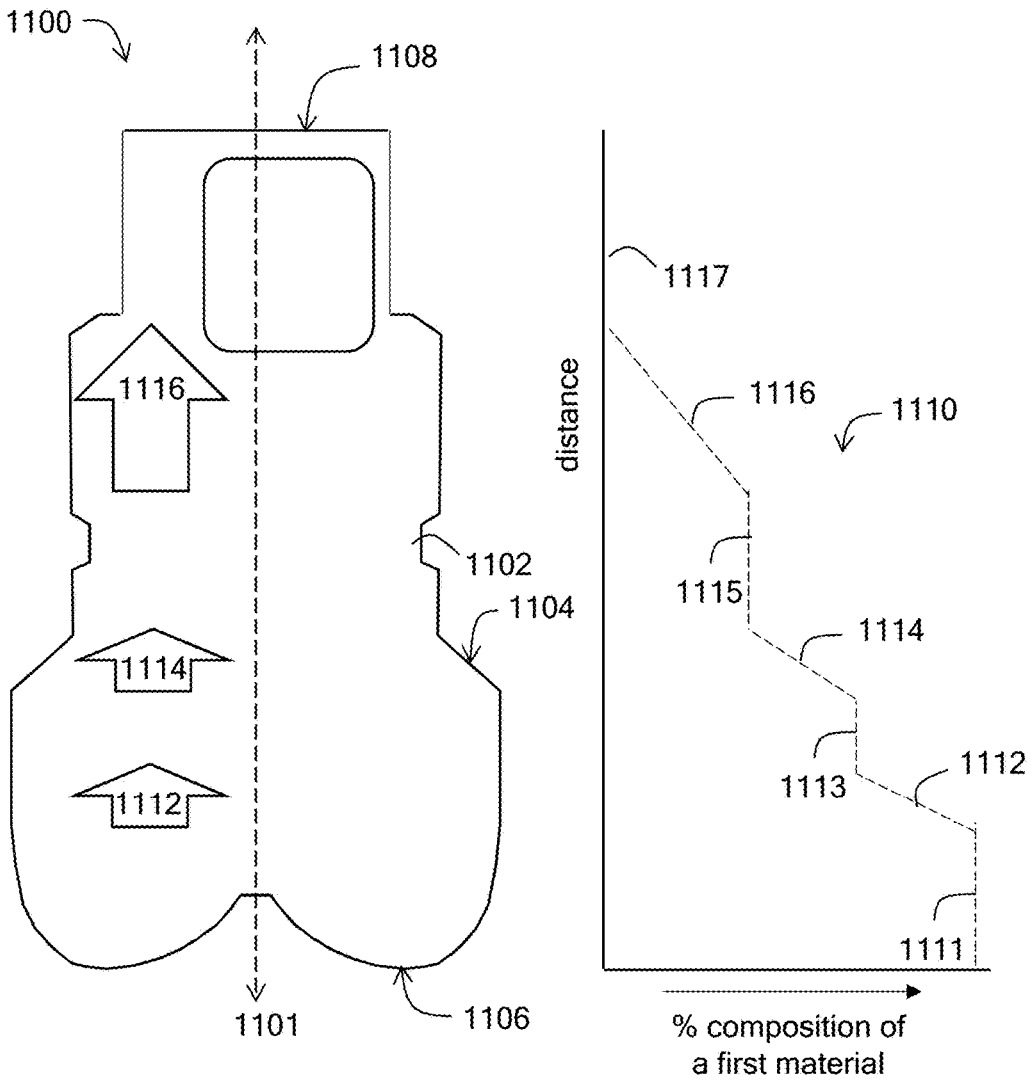
FIG. 11 is a cross-sectional, schematic view of a downhole cutting tool having a gradient composition, according to further embodiments of the present disclosure.

Referring now to FIG. 11, an example of an embodiment having a gradient composition including stepped changes in gradient compositional slope is shown. As shown, a cutting tool 1100 may include a body 1102 having a plurality of blades 1104 extending outwardly from the body and forming the cutting end 1106 of the cutting tool 1100, a connection end 1108 opposite the cutting end 1106, and a longitudinal axis 1101 extending axially through the body 1102. The composition design of the cutting tool model 1100 includes a gradient composition 1110 optionally having one or more axial gradients 1112, 1114, 1116 with a gradually changing amount of a first material in the composition along an axial distance of the cutting tool. In the embodiment shown, the axial gradients 1112, 1114, 1116 have negatively sloping compositional slopes and may be separated by axial portions of the cutting tool having a constant composition over an axial length of the axial portions), or by axial portions of the cutting tool having relatively steep compositional slopes (e.g., less than 5 wt % or less than 1 wt % change in an amount of a first material of the composition over the length of the axial portions), such that the gradient composition of the cutting tool has a generally stepped pattern in composition along a length of the cutting tool. In some embodiments, rather than a sloping axial gradient 1112, 114, 116, there may be an abrupt change in composition.

In the illustrated embodiment, a first axial portion of the cutting tool extending a distance from the cutting end 1106 of the cutting tool 1100 may include a first composition having a vertical (or undefined) compositional slope 1111, representing no compositional change over the length of the first axial portion. A second axial portion of the cutting tool extends a distance from the first axial portion and may include a second composition having compositional slope 1112. A third axial portion of the cutting tool extends a distance from the second axial portion and may include a third composition having a constant composition and a vertical (or undefined or very steep) compositional slope 1113. A fourth axial portion of the cutting tool extends a distance from the third axial portion and may include a fourth composition having compositional slope 1114. A fifth axial portion extends a distance from the fourth axial portion and may include a fifth composition having an undefined compositional slope 1115. A sixth axial portion of the cutting tool extends a distance from the fifth axial portion and may include a sixth composition having compositional slope 1116. A seventh axial portion of the cutting tool extends a distance from the sixth axial portion and may include a seventh composition having an undefined compositional slope 1117. The compositional slopes of the second, fourth and sixth axial portions 1112, 1114, 1116 may be the same or different. Further, although the stepped pattern of gradient composition 1110 includes seven axial portions forming the stepped pattern, other embodiments may include a different number of axial portions forming a stepped pattern. For example, in some embodiments, a gradient composition may include three, four, five, six or more than seven axial portions having compositional slopes forming a stepped pattern. Further, steps may be formed with abrupt changes in composition rather than using gradual, sloped changes.

In the embodiment shown, the axial portions may correspond with locations along the length of the cutting tool encountering different wear or erosion conditions. For example, the first composition forming the first axial portion of the cutting tool may extend a distance from the cutting end 1106 and may have a wear or erosion resistance suitable for encountering the most severe wear or erosion when compared to the remaining portions of the cutting tool. Compositions forming transitional sections of the cutting tool (e.g., the fourth axial portion forming the transition from the bladed region of the cutting tool to the shank portion of the cutting tool) may have compositional slopes that transition the material composition from more erosion resistant compositions to tougher or more machinable compositions. The seventh axial portion of the cutting tool (having the seventh composition with undefined compositional slope 1117) may form a connection end portion of the cutting tool, extending a distance from the connection end 1108 of the cutting tool, where the seventh composition may be relatively more machinable compared with the remaining axial portions of the cutting tool 1100.

Further, compositional slopes of one or more axial portions may vary according to axial position along a length of the cutting tool. For example, axial portions of a cutting tool 1100 having a transition in size and/or shape (e.g., an axial portion including the transition from the bladed region of a bit to the shank region of the bit; an axial portion including the transition from the shoulder region of a bit to the gage region of the bit; an axial portion including the transition from the shank region of a bit to a connection region of the bit) may have relatively shallow compositional slopes compared to axial portions of the cutting tool having a uniform size and/or shape. For example, FIG. 11 shows transition regions having negatively sloping compositional slopes (in second axial portion 1112, fourth axial portion 1114, and sixth axial portion 1116) and alternating axial portions having undefined slopes (1111, 1113, 1115, 1117). In the embodiment shown in FIG. 11, second axial portion including second compositional slope 1112 is positioned in a transition region from a shoulder region of the cutting tool 1100 to a gage region of the cutting tool, and the axial portions adjacent to and on either side of the second axial portion have relatively uniform compositions, where the first axial portion has undefined compositional slope 1111 through the shoulder region of the cutting tool 1100, and the third axial portion has undefined compositional slope 1113 through the gage region of the cutting tool 1100. According to embodiments of the present disclosure, a cutting tool may have one or more transitional axial portions extending an axial length along the cutting tool that includes a change in size and/or shape of the cutting tool outer perimeter, where transitional axial portions may have a greater change in composition over the transitional axial portion than the change in composition over an adjacent axial portion.

In some embodiments, compositional slopes of axial gradients may vary at different radial positions of a cutting tool to correspond with different conditions encountered by the cutting tool. For example, bladed drill bits may have a plurality of blades extending outwardly from the drill bit body, where two or more of the blades may have different shapes and/or sizes. In some embodiments, for example, primary blades may be longer and extend to a radial position nearer the longitudinal axis 1101 of the bit than do secondary or tertiary blades. The different blades may have axial gradients with different compositional slopes to correspond with the individual conditions of each blade type. For example, a first type of blade larger than a second type of blade on a drill bit may have a greater percent composition of erosion resistant material than the second type of blade. In some embodiments, an axial gradient formed through all or a portion of the first type of blade from the cutting end of the bit may have a relatively steeper compositional slope (or undefined slope) than an axial gradient formed through all or a portion of the second type of blade from the cutting end of the bit, such that an erosion resistant material may be present at a relatively higher percentage (by weight) for a distance from the cutting end in the first blade type farther than that in the second blade type.

Different blades may have axial gradient compositions formed therethrough having the same or different compositional slopes. For example, a relatively larger blade on a drill bit may have a relatively steeper compositional slope of a change in wear/erosion resistant material (having relatively less change in erosion resistant material amount by percent composition over the distance of the gradient) when compared with another relatively smaller blade on the drill bit in order to provide the relatively larger blade with more erosion resistance. In some embodiments, however, compositional slopes may provide different changes in material properties to one or more blades of a drill bit. For example, in some embodiments, one or more blades of a first type may be relatively taller and/or relatively more narrow when compared to a second blade type, where a first axial gradient may be formed through the first type of blade and a second axial gradient (different from the first axial gradient) may be formed through the second type of blade to provide the first type of blade with relatively higher toughness when compared to the second type of blade. In some embodiments, axial gradients having equal or unequal compositional slopes may be provided in a cutting tool to provide different axial portions of the cutting tool with relatively increased strength when compared to the remaining axial portions of the cutting tool. Different material properties along an axial gradient formed through a cutting tool may be provided by progressively increasing or decreasing one or more of the constituent materials forming the gradient composition.

Figure 12:
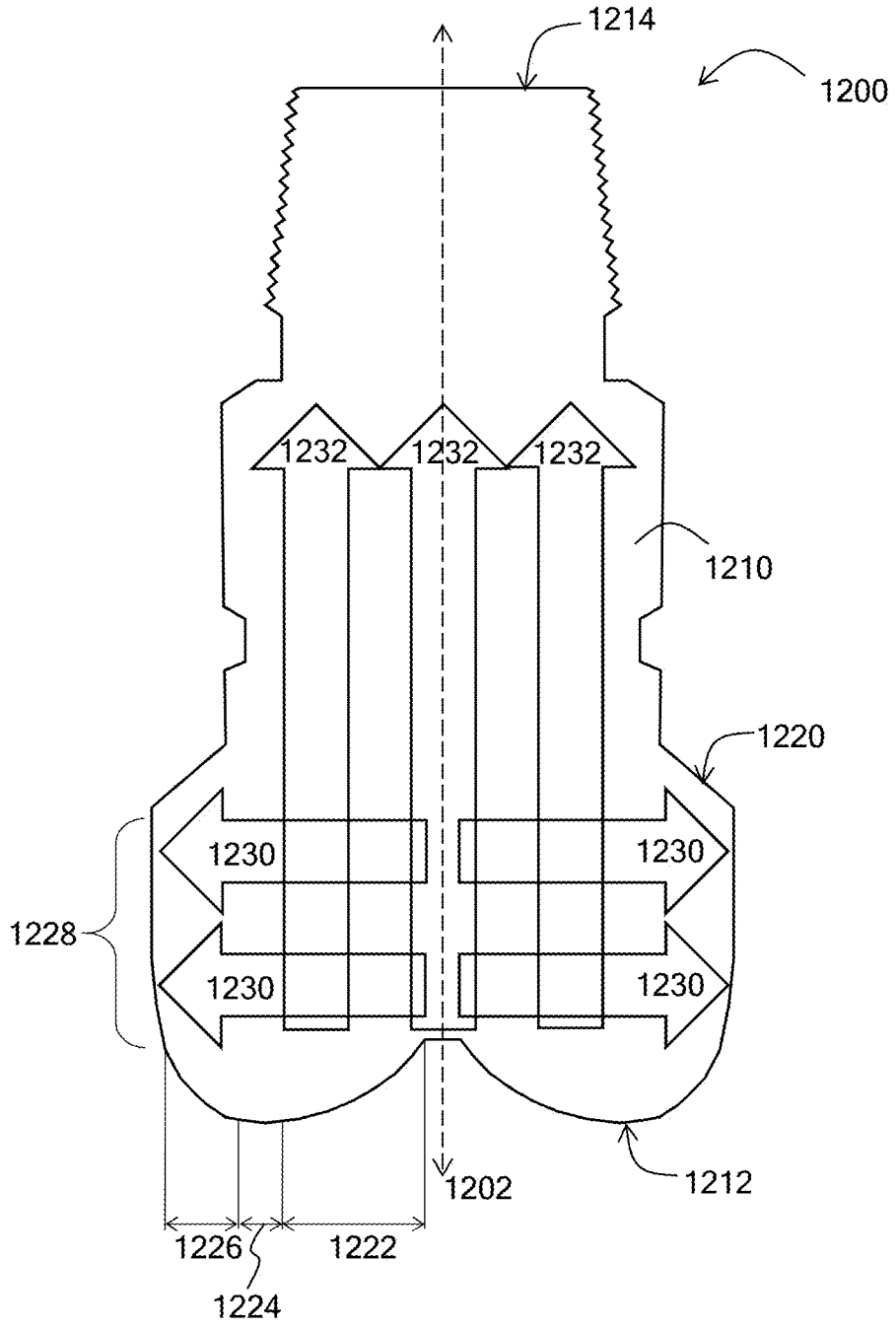
FIG. 12 is a cross-sectional, schematic view of a downhole cutting tool having a multi-directional gradient, according to some embodiments of the present disclosure.

FIG. 12 shows a cross sectional view of a downhole cutting tool 1200 having a bit body 1210 with a cutting end 1212, a connection end 1214, a longitudinal axis 1202 extending axially therethrough, and a plurality of blades 1220 extending outwardly from the bit body 1210. The blades 1220 may have a blade profile at the cutting end 1212 that includes a cone region 1222 proximate the longitudinal axis 1202, a nose region 1224 extending from the cone region to a shoulder region 1226, and the shoulder region 1226 extending to a gage region 1228. The cone region 1222 includes the radially innermost region of the blade profile, extending generally from the longitudinal axis 1202 to the nose region 1224. The cone region may extend axially downward (in a direction away from the connection end 1214), and may be generally concave, planar, or convex. Adjacent the cone region 1222 is the nose region 1224, which includes the region immediately around the axially lowermost point of the blade profile, referred to as a blade profile nose. At the blade profile nose, the slope of a tangent line to the blade profile is zero. Thus, as used herein, the term "blade profile nose" may refer to the point along a convex region of a blade profile of a cutting tool in rotated profile view at which the slope of a tangent to the blade profile is zero. The nose region 1224 may sometimes be considered part of the shoulder (or the upturned curve) region 1226 of the blade profile. As shown, the shoulder region 1226 may be generally convex. Moving radially outwardly, adjacent the shoulder region 1226 is the gage region 1228, which extends parallel to the longitudinal axis 1202 at the outer radial periphery of the blade profile.

The cutting tool body 1210 and blades 1220 may be integrally formed as a single piece having a varying composition throughout the cutting tool, for example, as opposed to other cutting tools that may have one or more components attached to or formed around a blank (e.g., a carbide portion of a body and blades formed in a mold around a steel blank used for forming the connection end of the cutting tool). The cutting tool 1200 may be formed both as an integral, single piece and as having a varying composition using additive manufacturing, as discussed in more detail herein.

In the embodiment shown in FIG. 12, the varying composition may include a gradient composition having gradients 1230, 1232 in multiple directions, each gradient 1230, 1232 extending a distance through the body and having variable and optionally progressively increasing and/or decreasing amounts of a first material in the composition along the direction in which the gradient extends. The gradients in composition are represented by arrows in FIG. 12. The gradient composition may include radial gradients 1230 extending from an interior portion to an exterior portion of one or more blades (or the tool body), where the interior portion composition has a first amount of the first material by percent composition, the exterior portion composition has a second amount of the first material by percent composition greater or lesser than the first amount. The first material may gradually or otherwise increase or decrease from the first amount to the second amount along the gradients 1230. In some embodiments, a gradient may include multiple steps, changes or other variations of the composition in the radial direction. For instance, both increasing and decreasing amounts of a first material in a composition may be positioned along the distance of the gradient (e.g., to provide an increase in and a decrease in erosion resistance along the direction and distance of the gradient).

One or more radial gradients in a cutting tool composition may extend a radial distance from an outer surface of the body (or from an outer surface of a blade extending from the body), where the radial distance may be greater than or equal to 75 percent of a cutting tool radius measured from the outer surface to the longitudinal axis 1202 of the cutting tool 1200. In some embodiments, one or more radial gradients may extend a radial distance equal to the cutting tool radius (from an outer surface of the cutting tool to the longitudinal axis). In some embodiments, a radial gradient may extend less than 75 percent of the cutting tool radius, for example, from an outer surface along a cone region 1222 of a blade to an outer surface along a shoulder region 1226 or gage region 1228 of the blade.

The arrows shown in FIG. 12 representing the radial gradients 1230 are spread a thickness (or axial height) along a full or partial gage region 1228 of the blades 1220. According to some embodiments of the present disclosure, one or more radial gradients may span an entire blade profile (from the nose to an upper surface of the gage region), a partial axial height of a blade profile (e.g., an axial height of a shoulder region 1226, an axial height of a cone region 1222, or from a blade profile nose to a partial axial height of the gage region 1228), or an axial height greater than the entire blade profile (e.g., from a blade profile nose to the connection end 1214 or from a blade profile nose to a portion of the body 1210 axially above the blades 1220). Further, where the rate of composition change along the gradient (referred to as a compositional slope) is progressive or continual, the rate of composition change along one or more radial gradients may vary along the axial height that the radial gradient expands.

In the embodiment shown, the cutting tool gradient composition may further include an axial gradient 1232 extending an axial distance in an axial direction (parallel with the longitudinal axis 1202), where the changing amounts of the first material varies along the axial direction. For example, in some embodiments an axial gradient 1232 may include gradually decreasing amounts of a first material in the composition along the axial direction from the cutting end 1212 toward the connection end 1214, where the first material has the greatest erosion resistance relative to the remaining constituents of the composition. The axial gradient 1232 may span an entire diameter (width) of the cutting tool or may span a partial width of the cutting tool 1200. Further, the rate of composition change along the gradient (the compositional slope) of one or more axial gradients may vary along the width the axial gradient spans.

The cutting tool shown in FIG. 12 is a fixed cutter drill bit. However, other cutting tool bodies may be manufactured according to embodiments of the present disclosure to having multi-gradient compositions, for example, to provide erosion resistant outer surfaces, relatively tougher interior regions, and transitioning compositions therebetween.

According to embodiments of the present disclosure, a cutting tool may have one or more gradient compositions extending in a single direction or in multiple directions. For example, a cutting tool may include one or more radial gradients extending in a radial direction and having progressively increasing and/or decreasing amounts of a first material in the composition along the radial direction, one or more axial gradients extending in an axial direction and having progressively increasing and/or decreasing amounts of a first material in the composition along the axial direction, one or more lateral gradients extending in a lateral direction (parallel with a radial direction) and having progressively increasing and/or decreasing amounts of a first material in the composition along the lateral direction, or one or more azimuthal gradients extending in an azimuthal direction (e.g., around an outer perimeter of the cutting tool) and having progressively increasing and/or decreasing amounts of a first material in the composition. In some embodiments, a cutting tool may include gradients extending in a combination of two or more of the axial, radial, lateral and azimuthal directions (e.g., extending laterally and axially).

Multi-directional gradient compositions (compositions having gradients extending in multiple directions) may form a three-dimensional compositional gradients or variances throughout the cutting tool. The rate of compositional change of a first material in the composition may be defined in terms of a compositional slope of an amount of the first material along the gradient composition, where the compositional slope is equal to an interval of the total gradient distance over a change in percent composition of the first material in the composition. According to some embodiments of the present disclosure, multi-gradient compositions may include two or more of the gradients having different compositional slopes. In some embodiments, multi-gradient compositions may have each gradient with substantially equal compositional slopes, where two or more gradients extend in different directions and/or extend different distances.

Cutting tool compositions may include one or more of an erosion resistance material, such as transition metal carbide, e.g., tungsten carbide, a metallic binder, and steel, where different combinations of the materials and in different amounts may be distributed in different regions of the cutting tool. For example, a composition at a cutting tool cutting end may include a mixture of tungsten carbide and metallic binder without steel, while a cutting tool connection end may have a composition absent tungsten carbide that includes steel, or which may include tungsten without tungsten carbide or with reduced amounts of tungsten carbide. Suitable metallic binders may include alloys of copper, nickel, zinc, and tin. For example, a binder alloy may have a composition by weight of about 52 wt % copper, 15 wt % nickel, 23 wt % manganese, and 9 wt % zinc. In another example, a binder alloy may include a composition by weight of manganese in a range of about 0 to 25 wt %, nickel in a range of about 0 to 15 wt %, zinc in a range of about 3 to 20 wt %, tin in a range of more than 1 wt % to about 10 wt %, and copper making up the remainder by weight of the alloy composition. Steels may include carbon steel (e.g., steel having about 0.1-0.5 wt % carbon content) or other machinable steels.

Gradient compositions formed through the cutting tool may include a progressively increasing or decreasing amount of a first material in the composition and optionally a progressively decreasing or increasing amount of a second material inversely corresponding to the change in percent composition of the first material along the direction in which the gradient extends. For example, a gradient composition may include a progressively decreasing amount of a wear or erosion resistant material (e.g., tungsten carbide) in the composition, along the gradient and a progressively increasing amount of a second material in the composition (e.g., steel, tungsten, or a metallic binder material) inversely corresponding to the change in percent composition of the erosion resistant material along the direction in which the gradient extends, thereby providing a composition having a relatively higher erosion resistance at a first end of the gradient and a composition having a relatively higher toughness at a second end of the gradient.

A changing composition in a cutting tool may be provided by depositing the composition layer-by-layer into the three dimensional structure of the cutting tool, where the material composition of each layer is selected to provide the changing composition at the deposition layer level. Methods of depositing a material composition according to embodiments of the present disclosure may use an additive manufacturing deposition device, where each layer may be deposited using one or more feeders or nozzles of the deposition device. The material composition of each layer, as well as the physical design parameters of each layer (e.g., shape of the outer perimeter of each layer, area of each layer, thickness of each layer, locations of different material compositions), may be designed prior to deposition using a software modeling program, such as a computer aided design ("CAD") system.

According to some embodiments, an additive manufacturing process of forming a cutting tool body may include depositing a first layer of a selected material composition (according to a first grid pattern of a cutting tool body model) using one or more feeders of a deposition device. The first layer composition may include a first material, a second material and a metallic binder, where the first material is present in a first amount by percent composition. Subsequent layers may be deposited using the feeders of the deposition device, where one or more of the subsequent layers may have a subsequent material composition different than the first layer composition and including a second amount of the first material by percent composition. A laser or electron beam ("E-beam") may be used to heat each layer as or after each layer is deposited to a sintering temperature to sinter the layers as they are deposited, thereby forming the cutting tool body in a sequential layer-by-layer manner. Sintering layers as they are deposited using a laser, in a layer-by-layer manner, may be referred to as laser sintering. In some embodiments, the first layer may include different cells or portions that have different compositions, thereby creating a gradient or variation in composition that is within a layer. Accordingly, compositional variation may occur axially (i.e., different layers have different compositions), radially (i.e., different portions of the same layer have different compositions), or combinations of axially and radially.

In some embodiments, the minimum thickness of the layers is limited by the particle size of the material that is being layered, with the minimum layer thickness being equal to or greater than the diameter of the particular material being layered. In some embodiments, each layer may have a thickness ranging from 0.002 in. (50 μm) to 0.020 in. (510 μm). The number of distinct layers may vary. For instance, the number of layers may be within a range including a lower limit, an upper limit, or lower and upper limits including any of 400, 500, 1,000, 2,000 5,000, 10,000, 100,000, or values therebetween. In some embodiments, the number of layers may be less than 400 or greater than 100,000. The number of layers may be at least partially dependent on the height/size of the cutting tool being built and the size of particles being deposited. In some embodiments, different layers have different heights.

As discussed herein, in some embodiments, multiple types of material in a composition (for example, materials having a difference in shape, size, or chemical composition) may be applied as a single layer. For example, a first composition may be deposited by a deposition device in a first region of a layer, and a second composition may be deposited by a separate pass of the deposition device in a second region of the layer, such that the deposited layer has at least two distinct regions formed of the first composition and the second composition. In other embodiments, a material mixture of a first composition and second composition (the first composition having at least a different shape, size, or chemical composition than the second composition) may be deposited in a single pass of a deposition device. For example, a deposition device may have two or more feeders or nozzles, where each feeder/nozzle may be used to deposit a different material in a different region of the layer during a single pass. In another example, a deposition device may have two or more feeders or nozzles, where each feeder/nozzle may deposit a different material simultaneously during a pass to form a layer of composite material, e.g., a combination of metallic material and an adhesive or an organic binder. According to some embodiments, a deposition device may have two or more feeders or nozzles, where each feeder/nozzle may feed one of multiple materials forming a composition. Feeders on a deposition device may include nozzles to control the amount of material fed from the feeder, thereby helping to control the resolution of a composition layer being deposited. In some embodiments, nozzles on feeders may be adjustable to allow material to be flowed through the feeder at higher or lower flow rates. According to some embodiments of the present disclosure, multiple materials in a composition may be deposited by a deposition device according to a grid pattern. The grid pattern may be developed according to a three-dimensional model of a cutting tool body having gradients or other variations in composition formed throughout, where the cutting tool model is divided into a plurality of thin cross-sectional, two dimensional planes to develop grid patterns according to the composition making each cross-sectional plane.

Figure 13:
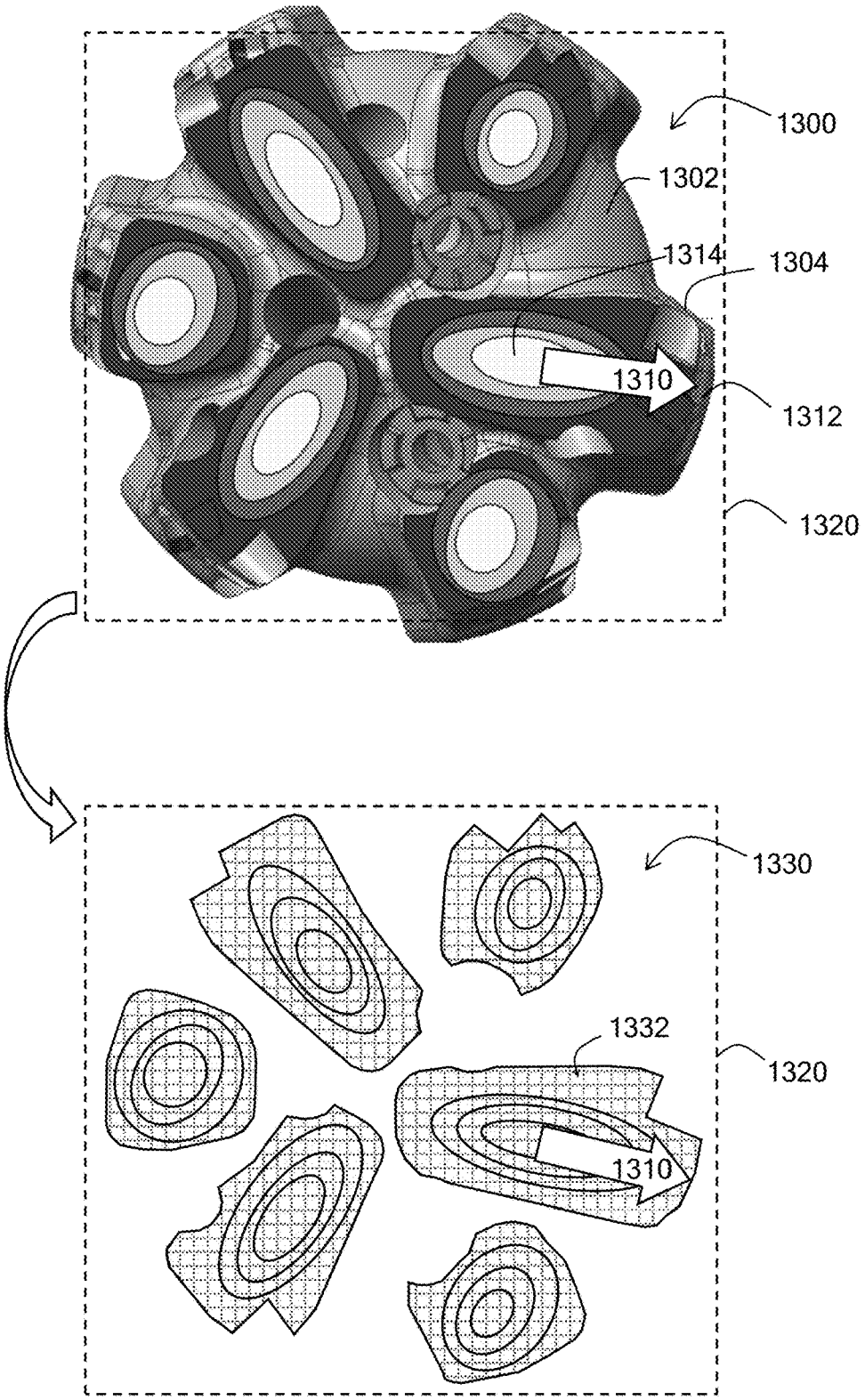
FIG. 13 shows a grid pattern developed from a cutting tool model, according to some embodiments of the present disclosure.

FIG. 13 is a cross-sectional view of an example of a drill bit model having a multi-gradient compositional design taken from the sectional plane. The drill bit 1300 includes a body 1302 having a plurality of blades 1304 extending outwardly from the body and forming the cutting end of the drill bit (where the sectional view is taken at the cutting end of the bit). The drill bit composition includes gradients 1310 extending in multiple directions, including radial directions shown in the sectional view, and axial directions as shown and discussed herein. In the embodiment shown, the gradient composition includes radial gradients 1310 extending from interior portions of the drill bit to exterior portions of the drill bit. Particularly, the radial gradients 1310 formed along the sectional plane 1320 exposed in the sectional view of FIG. 13 extend from an interior portion of each blade 1304 to exterior portions of the blades 1304, where the composition along an outer surface 1312 of the blade 1304 has greater erosion resistance than the composition at the interior portion 1314 of the blade 1304. The particular embodiment in FIG. 13 also shows that a gradient may extend radially from an interior portion of each blade 1304 to interior portions of the blades 1304, and/or in one or more circumferential directions from an interior of a blade 1304 toward exterior leading and trailing surfaces of the blade 1304.

In some embodiments, the gradient composition may include gradually increasing or decreasing amounts of tungsten carbide or other wear/erosion resistant materials, and decreasing amounts of steel from an interior portion of a cutting tool to an exterior portion of the cutting tool to provide the exterior portions with greater erosion resistance along the exterior of the cutting tool. In some embodiments, differing types and/or sizes of tungsten carbide or other wear/erosion resistant material (e.g., carbides or borides) may be deposited at an interval to form a gradient composition having an erosion resistance gradient (i.e., a gradient in the erosion resistance of the composition).

In the embodiment shown, the gradient composition of the cutting tool 1300 may include varying mixtures of steel, tungsten carbide (and/or other erosion resistant material), a metallic binder, and optionally, an adhesive or organic binder to provide regions of relatively higher wear or erosion resistance. A relatively lower wear/erosion resistant composition in the gradient composition may include relatively higher amounts of steel and/or metallic binder, and a relatively higher wear/erosion resistant composition in the gradient composition may include relatively higher amounts of tungsten carbide. For example, the interior portions 1314 of the cutting tool may have a composition including between 0 and 30 wt % tungsten carbide, while the exterior portions along the outer surface 1312 of the cutting tool may have a composition including between 40 and 90 wt % tungsten carbide (and in particular embodiments, between 60 and 90 wt % tungsten carbide), where the gradient composition may gradually transition from the interior portion composition to the exterior portion composition by including gradually increasing amounts of tungsten carbide moving from the interior portion to the exterior portion. In some embodiments, a "gradually increasing" amount of tungsten carbide may include a change of less than 5 wt % of tungsten carbide at a resolution interval (where the resolution interval is an interval of the total distance of the gradient in composition equal to the resolution of the deposition device, and the resolution of the deposition device being equal to the thickness of the material layer deposited by the deposition device).

In the embodiment shown in FIG. 13, the sectional plane 1320 is taken along a plane perpendicular to a longitudinal axis of the cutting tool. According to some embodiments of the present disclosure, a cutting tool model may be divided as a plurality of radial planes (sectioned perpendicularly to a longitudinal axis extending axially through the cutting tool). However, in some embodiments, sectional planes may be divided along a non-axial axis.

The compositional design along the sectional plane 1320 may be transferred to a grid pattern 1330 of the sectional plane 1320. Particularly, as shown, the compositional design along the sectional plane 1320 may be transferred to a grid pattern 1330 of the sectional plane 1320 by transferring the pattern of the compositional design over a grid overlaying the outline or perimeter of the cutting tool 1300 along the sectional plane 1320. In such a manner, gradients 1310 formed through the compositional design may be transferred onto a grid of the grid pattern having cells 1332 of a selected size, such that a particular composition according to the compositional design is designated to each cell 1332. Cell sizes may have widths, for example, from about 0.002 in. (50 μm) to 0.020 in. (510 μm). In some embodiments, cell sizes may be based on a particle size, where the cell size in a grid may be selected according to the particle sizes of the composition. For example, in some embodiments, the cell size of a grid pattern may be one, two, three, five, or ten times larger than a maximum particle size in the composition. By designating a composition to each cell on grid patterns forming a cutting tool model and depositing the composition in an additive manufacturing process to build a cutting tool according to the grid patterns, a change in composition (e.g., in gradient compositions) may be provided at the cell level, thereby providing a cutting tool formed by additive manufacturing having highly controlled changes in composition.

According to embodiments of the present disclosure, a method of manufacturing a downhole cutting tool may include providing a model of a cutting tool having a varying composition. The cutting tool model may be divided into a plurality of sectional planes (e.g., in radial planes along an axial direction of the cutting tool), where the sectional planes may have a thickness according to the depth of the layers to be deposited during the additive manufacturing process of forming the cutting tool, such as described above. The composition of the cutting tool model may vary along at least one of the sectional planes, as well as across adjacent sectional planes (e.g., in the axial direction in embodiments having sectional planes divided along the axial direction). A grid pattern may be generated for each of the sectional planes, where the compositional design of each sectional plane forming the cutting tool is mapped over a grid on the grid pattern.

A deposition device having multiple feeders and nozzles may be used to deposit the varying amounts of materials forming the varying composition of the cutting tool model using an intelligent programming system to control the multiple feeders. Methods using the multi-feeder deposition device may include depositing a first layer of a composition on a substrate according to a first grid pattern. As used herein, a substrate may refer to a platform or base that is separate from but supports the cutting tool as it is manufactured, or a substrate may refer to any layer of the cutting tool that has a second or subsequent layer deposited thereon, depending on the stage of manufacture. For example, a first step of manufacturing a cutting tool may include depositing a first layer on a substrate or base that is separate from the cutting tool, and in a second step of manufacturing the mold, the first layer may be the substrate for a second or subsequent layer deposited thereon.

A first grid pattern may have a varying composition or a uniform composition across each of the cells forming the grid pattern, where the multiple feeders of the deposition device may deposit the materials forming the composition design of the first grid pattern in a corresponding grid layout on a substrate. For example, a first grid pattern may include a uniform compositional design including a mixture of tungsten carbide and a metallic binder. A tungsten carbide feeder of the deposition device may deposit tungsten carbide, and a metallic binder feeder may deposit metallic binder in a first layer on a substrate according to the compositional design of the first grid pattern. A laser may be passed over the deposited first layer to heat the metallic binder material to a sintering temperature to sinter the composition of the first layer.

A second grid pattern of the cutting tool model may have a varying composition or a uniform composition across each of the cells forming the second grid pattern. Further, the second grid pattern may have the same compositional design as the first grid pattern or may have a different composition design as the first grid pattern, depending on whether an axial compositional gradient is designed to extend into the first and second sectional planes and/or depending on the interval of a gradient composition (e.g., when a gradient composition interval is greater than or equal to the thickness of two deposited layers, the composition of adjacent layers may be the same, or when a gradient composition interval is equal to the thickness of one deposited layer, the composition of adjacent layers may be different). For example, in embodiments where an axial compositional gradient is designed to extend into the first and second sectional planes, a second grid pattern may include a compositional design different from the first grid pattern and including a mixture of tungsten carbide, steel and a metallic binder. A tungsten carbide feeder of the deposition device may deposit tungsten carbide in locations of the second layer corresponding to the designated cells of the second grid pattern containing tungsten carbide, a steel feeder of the deposition device may deposit steel in locations of the second layer corresponding to the designated cells of the second grid pattern containing steel, and a metallic binder feeder may deposit metallic binder in locations of the second layer corresponding to the designated cells of the second grid pattern containing metallic binder. A laser may be passed over the deposited second layer to heat the metallic binder material to a sintering temperature to sinter the composition of the second layer to the first layer.

Subsequent grid patterns of the cutting tool model may have a varying composition or a uniform composition across each of the cells forming the subsequent grid patterns. Further, subsequent grid patterns may have the same compositional design as an adjacent grid pattern and/or may have a different composition design as an adjacent grid pattern. For example, in embodiments having a subsequent grid pattern with a varying composition (e.g., having a radial gradient composition), the subsequent grid pattern may include a compositional design having different amounts of tungsten carbide in different regions of the subsequent grid pattern, different amounts of steel in the different regions of the subsequent grid pattern, and different amounts of metallic binder in the different regions of the subsequent grid pattern. A tungsten carbide feeder of the deposition device may deposit tungsten carbide in locations of the subsequent layer corresponding to the designated cells of the subsequent grid pattern containing tungsten carbide, a steel feeder of the deposition device may deposit steel in locations of the subsequent layer corresponding to the designated cells of the subsequent grid pattern containing steel, and a metallic binder feeder may deposit metallic binder in locations of the subsequent layer corresponding to the designated cells of the subsequent grid pattern containing metallic binder. A laser may be passed over the deposited subsequent layer to heat the metallic binder material to a sintering temperature to sinter the composition of the subsequent layer to the previously deposited and adjacent layer.

Varying compositions (deposited throughout different deposited layers and/or deposited along a single deposited layer) may include material mixtures having varying particle shapes, varying particle size, and/or different material types.

Figure 14:
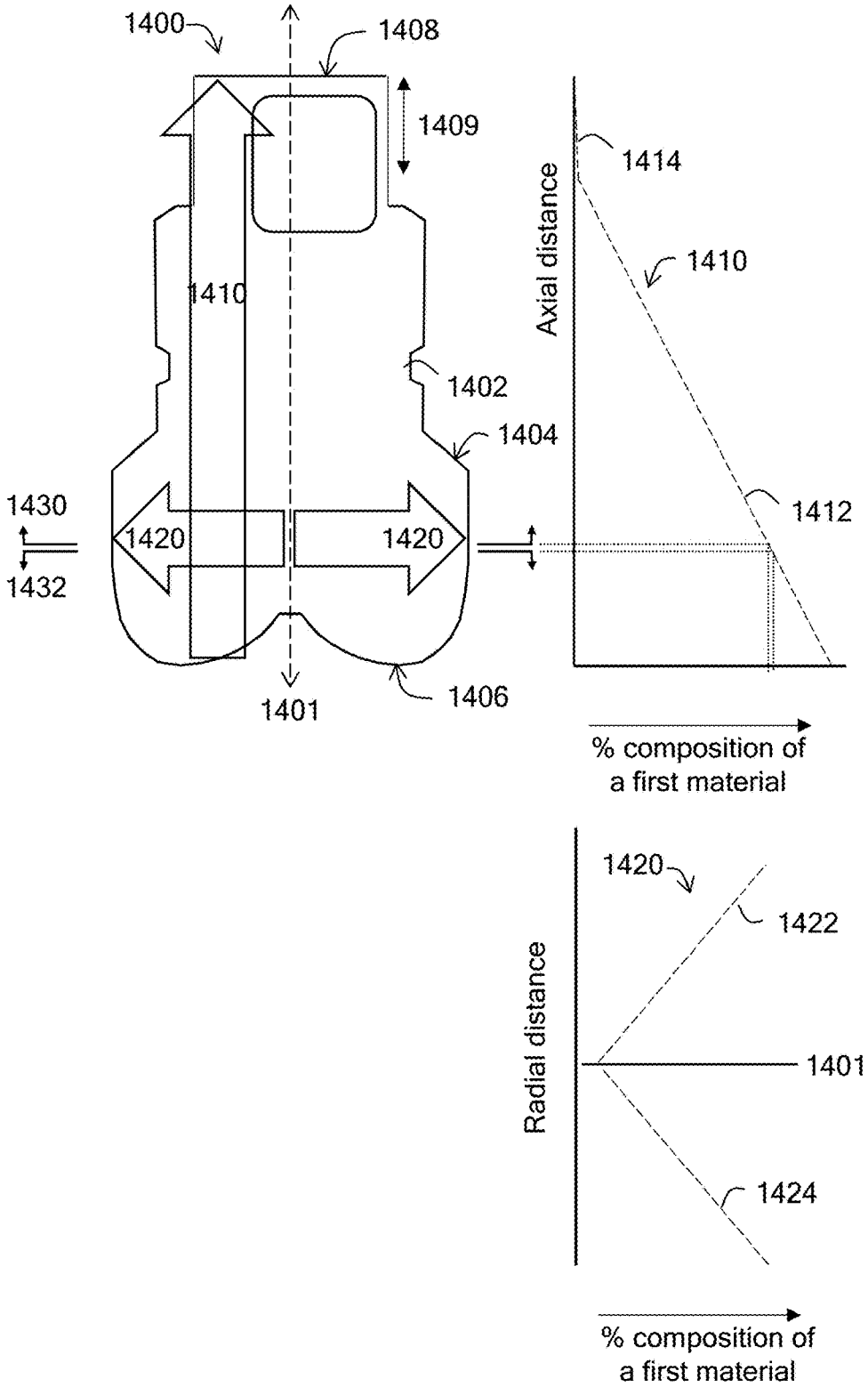
FIG. 14 is a cross-sectional diagram of a cutting tool model and graphs of a gradient composition design of the cutting tool model, according to some embodiments of the present disclosure.

Referring now to FIG. 14, an example is shown of a diagram of multiple grid patterns taken from a cutting tool model having a gradient composition design graphed along a cross-sectional view of the cutting tool. As shown, the cutting tool model is a drill bit model 1400 including a body 1402 having a plurality of blades 1404 extending outwardly from the body and forming the cutting end 1406 of the drill bit, a connection end 1408 opposite the cutting end 1406, and a longitudinal axis 1401 extending axially through the body 1402. The composition design of the drill bit model 1400 includes an axial gradient 1410 having a gradually decreasing amount of a first material in the composition along an axial distance from the cutting end 1406 and a radial gradient 1420 having a gradually decreasing and increasing amount of the first material in the composition along a radial distance extending between two opposite outer surfaces of the bit.

The axial gradient 1410 may include a first axial gradient portion having a first compositional slope 1412 over a first portion (e.g., the cutting end portion and a shaft portion of the bit) of the distance of the axial gradient 1410. A second axial gradient portion may have a second compositional slope 1414 over a second portion of the distance of the axial gradient 1410 (e.g., extending over a connection end portion 1409 of the body, the connection end portion 1409 extending an axial distance from the connection end 1408). The first compositional slope 1412 may be different from the second compositional slope 1414. For example, as shown, the second compositional slope 1414 may include a relatively steep slope having very little or no change in composition over the connection end portion 1409 of the cutting tool, for example, having less than 1 wt % or less than 5 wt % change in composition over the connection end portion 1409 of the cutting tool, whereas the first compositional slope 1412 may include a relatively shallow slope having a relatively larger percent change in composition over the first portion of the axial gradient distance (e.g., the cutting end and shaft portions of the cutting tool). The first compositional slope 1412 may include a gradually decreasing amount of erosion resistant material in the composition from the cutting end to the second compositional slope 1414 (e.g., ranging from up to 90 or 95 wt % of a wear/erosion resistant material in the composition at the cutting end 1406 to about 30 wt %, 20 wt %, 10 wt %, or less of the erosion resistant material in the composition at a portion of the cutting tool between the shaft portion and the connection end portion of the cutting tool). The second compositional slope 1414 may include a composition having a substantial majority (or entire) composition of soft metallic material suitable for machining (e.g., steel). In some embodiments, a compositional slope may be undefined (x=0), where the composition may not change over a selected portion of the cutting tool. For example, in some embodiments, a connection end portion of a cutting tool may be printed as having a uniform composition of steel or other soft metallic matrix material suitable for machining and/or welding to a connection piece.

A connection end portion of a cutting tool may include the portion of the cutting tool extending an axial distance from the cutting end as discussed herein, depending on the overall size of the cutting tool. In some embodiments, a cutting end portion may include the portion of the cutting tool extending a percentage of the axial distance from the cutting end as discussed herein.

The radial gradient 1420 may include a first radial gradient portion having a first compositional slope 1422 and a second radial gradient portion having a second compositional slope 1424, different than the first composition slope 1422. In the embodiment shown, the first radial gradient portion has a progressively decreasing amount of the first material by percent composition from an outer surface of the bit to an interior portion of the bit, and the second radial gradient portion has a progressively increasing amount of the first material by percent composition from the interior portion to an opposite outer surface of the bit. The first and second radial gradient portions may have compositional slopes substantially mirror to one another to create a radial gradient design across the width of the bit of increased amounts of the first material at the outer surfaces and progressively decreasing amounts of the first material in a direction toward the central longitudinal axis 1401 of the bit. Other embodiments may include radial gradient(s) having different compositional slopes to form different radial compositional designs. In some embodiments, greater amounts of an erosion resistant material (e.g., carbide) by percent composition may be at an end of a radial gradient at an outer surface of the cutting tool, and greater amounts of a relatively tougher material (e.g., metal) by percent composition may be at an end of the radial gradient in an interior portion of the cutting tool.

The drill bit model 1400 may be divided into a plurality of thin cross-sectional, two dimensional planes to develop grid patterns according to the composition making each cross sectional plane. Each grid pattern 1430, 1432 is mapped from a cross-sectional plane transversely extending through the longitudinal axis 1401 at different axial locations, along adjacent intervals of the axial gradient distance. The composition of the drill bit along each plane is mapped into the grid patterns 1430, 1432, such that each cell of the grid has the particular composition of the corresponding locations in the drill bit model 1400. The compositions of the drill bit model 1400 may be graphed as a function of axial position within the drill bit model 1400 (e.g., the particular cross-sectional plane) and as a function of radial position within the drill bit model (e.g., using polar, x-y, or other coordinate systems). The composition mapped to cells may be varied (non-uniform) across two or more grid patterns, such that multiple gradient compositions may be formed axially and radially through the multiple grid patterns.

According to embodiments of the present disclosure, a method of manufacturing a drill bit may include providing a drill bit model 1400, dividing the drill bit model 1400 into multiple cross-sectional planes, mapping a composition of each of the planes into a grid pattern (e.g., grid patterns 1430 and 1432), and successively depositing a volume of the composition using a deposition device according to each of the grid patterns in sequential layers to build a three-dimensional body of the drill bit or other cutting tool.

According to embodiments of the present disclosure, bladed drill bits may have a plurality of blades extending outwardly from the drill bit body. According to embodiments of the present disclosure, different blades of a cutting tool may have one or more gradients with different compositional gradients to correspond with the individual conditions of each blade type. For example, an axial gradient formed from the cutting end of a bit through all or a portion of a first type of blade may have a relatively steeper compositional slope (or undefined slope) than an axial gradient formed from the cutting end of the bit through all or a portion of a second type of blade, such that a wear or erosion resistant material may be present at a relatively higher percentage (by composition) for a distance from the cutting end in the first blade type farther than that in the second blade type. In some embodiments, different gradients (axial, radial, lateral or combinations thereof) may be formed in a first type of blade and a second type of blade on a bit (e.g., a primary vs. secondary blade), where a larger amount of change in percent composition of erosion resistant material along the gradient(s) may be present in the second type of blade than the first type of blade. In some embodiments, different gradients may be designed through different types of blades of a cutting tool to provide a first type of blade (larger than a second type of blade) with a greater amount of wear/erosion resistant material at the outer surfaces of the first type of blade than at the outer surfaces of the second type of blade. In some embodiments, a first type of blade larger than a second type of blade on a drill bit may have a greater percent composition of erosion resistant material than the second type of blade.

Different blades may have gradient compositions formed there through having the same or different compositional slopes. For example, a relatively larger blade on a drill bit may have a relatively steeper compositional slope of a change in wear/erosion resistant material (having relatively less change in erosion resistant material amount by weight percent composition over the distance of the gradient) when compared with another relatively smaller blade on the drill bit in order to provide the relatively larger blade with more erosion resistance. However, in some embodiments, compositional slopes may provide different changes in material properties to one or more blades of a drill bit. For example, in some embodiments, one or more first type of blade of a drill bit may be relatively taller and/or relatively more narrow when compared to a second type of blade of the drill bit, where a first gradient may be formed through the first type of blade and a second gradient (different from the first axial gradient) may be formed through the second type of blade to provide the first type of blade with relatively higher toughness through an interior region of the first type of blade when compared to the second type of blade. In some embodiments, gradients having equal or unequal compositional slopes may be provided in a cutting tool to provide different portions of the cutting tool with relatively increased strength when compared to the remaining portions of the cutting tool. Different material properties along one or more gradients formed through a cutting tool may be provided by progressively increasing or decreasing one or more of the constituent materials forming the gradient composition.

In some embodiments, compositions may comprise powdered materials. The powdered materials in embodiments covered by this disclosure may include carbides, such as tungsten carbide, oxides, borides, nitrides, silicates and metals, such as steel, alloys, and metallic binder materials. In some embodiments, the powdered materials that are metals may include silicon, titanium, tantalum, molybdenum, and tungsten. In one or more embodiments, a second material may be coated on a first material to form a material mixture.

The particle size of the powdered materials may be from about 10 nm to about 200 μm. In more particular embodiments, the particle flow during the layering process may be enhanced when the particle size of the powdered materials is at least about 50 μm. In some embodiments, the particle size of the powdered materials may be from about 10 μm to about 200 μm. In more particular embodiments, the particle size of the powdered materials may be from about 50 μm to about 100 μm.

In some embodiments, powdered materials may be granulated prior to their deposition. The granulated powders may be substantially circular and possess diameters from about 0.1-4 mm. For example, in some embodiments, granulated powders may be formed by the granulation of a single material, while in other embodiments, granulated powders may be formed by the granulation of at least two different materials (having a difference in at least one of particle shape, particle size, or material type) to form a material mixture. During the granulation of at least two different materials, the materials may form a substantially homogenous granule. In other embodiments, one material may be confined substantially to the interior of a granule while the other material may be substantially on the exterior of the granule to form a granule with a core-shell motif. A core-shell granule may be created by granulating one powdered material first to create a first granule and then granulating the first granule with another powdered material to create the final core-shell granule. However, in some embodiments, a core-shell granule may result from the direct granulation of at least two powdered materials with differing particle sizes. In some embodiments, the core of the granule may substantially include the powdered materials with larger particle size and the exterior of the granule may include the powdered materials with smaller particle size, while in some embodiments the opposite may also occur. In embodiments using granulated powders, the particle size of the powders making up the granule may be as small as about 10 nanometers.

In embodiments using organic binders or adhesives, suitable organic binders may be or include one or more waxes or resins that are insoluble, or at least substantially insoluble, in water. Waxes may include, for example, animal waxes, vegetable waxes, mineral waxes, synthetic waxes, or any combination thereof. Illustrative animal waxes may include, but are not limited to, bees wax, spermaceti, lanolin, shellac wax, or any combination thereof. Illustrative vegetable waxes may include, but are not limited to, carnauba, candelilla, or any combination thereof. Illustrative mineral waxes may include, but are not limited to, ceresin and petroleum waxes (e.g., paraffin wax). Illustrative synthetic waxes may include, but are not limited to, polyolefins (e.g., polyethylene), polyol ether-esters, chlorinated naphthalenes, hydrocarbon waxes, or any combination thereof. An organic binder may also include waxes that are insoluble in organic solvents. Illustrative waxes that are insoluble in organic solvents may include, but are not limited to, polyglycol, polyethylene glycol, hydroxyethylcellulose, tapioca starch, carboxymethylcellulose, or any combination thereof. Illustrative organic binders may also include, but are not limited to, starches, and cellulose, or any combination thereof. The organic binders may also include, but are not limited to, microwaxes or microcrystalline waxes. Microwaxes may include waxes produced by de-oiling petrolatum, which may contain a higher percentage of isoparaffinic and naphthenic hydrocarbons as compared to paraffin waxes. Other suitable binders may include, for example, sodium silicate, acrylic copolymers, arabic gum, portland cement and the like. Binders may be deposited in solid or liquid form.

Particle size ranges for materials deposited by deposition devices may depend, for example, on the type of material being deposited, the region of the cutting tool body being formed, the type of deposition device used, and the amount of porosity desired in the cutting tool body design, but may range from nano-sized, micro-sized and larger. For example, in some embodiments, particles being deposited may range from less than 1 micron, from 1-10 microns, from greater than 10 microns, and greater than 100 microns, where various sub-ranges thereof may be used alone or in combination to form a layer of material being deposited.

According to embodiments of the present disclosure, selected material mixtures may be deposited to form different regions of a cutting tool body, depending on, for example, the desired properties of the cutting tool body. For example, according to some embodiments, one or more layers being deposited to form a cutting tool body may include a first composition (comprising a first material mixture) and a second composition (comprising a second material mixture different from the first material mixture), where the first and second compositions form different regions of the one or more layers. The different regions may provide desired properties to different parts of the cutting tool body. By using the grid patterns of a cutting tool model and intelligent deposition system described herein to control multiple feeders to deposit selected materials in locations corresponding to designated cells in the grid patterns, changes in the built cutting tool body composition may be precisely controlled to provide fine resolution gradient compositions through the cutting tool body. For example, intelligent deposition systems according to embodiments of the present disclosure may be used to provide a fine resolution gradient composition having a compositional slope of greater than 0 and less than 5 percent by composition change in amount of a first material in the composition over an interval equal to the resolution of the deposition device (i.e., the thickness of the material layer deposited by the deposition device).

Forming gradients of different types of materials through a cutting tool may provide different gradients of material properties. For example, gradients of progressively decreasing amounts of tungsten carbide and corresponding progressively increasing amounts of steel and/or other metallic matrix material may provide a gradient having increased erosion resistance at the end of the gradient having greater amounts of tungsten carbide and having increased material strength and toughness at the end of the gradient having greater amounts of steel and/or other metallic matrix material.

Further, cutting tool bodies having multi-gradient compositions may be built using intelligent deposition systems according to embodiments disclosed herein, where the built cutting tool body may be ready for use with or without further processing. For example, by laser or electron beam sintering layers deposited by intelligent deposition systems according to embodiments of the present disclosure, a cutting tool body having a multi-gradient composition may be built in a layer-by-layer manner to exact or near exact specifications.

Although the embodiments of bits, cutting elements, and fluid conduits have been primarily described with reference to wellbore drilling operations, the embodiments within the scope of the present disclosure may be used in applications other than the drilling of a wellbore. In other embodiments, bits, cutting elements, and fluid conduits according to the present disclosure may be used outside a wellbore or other downhole environment used for the exploration or production of natural resources. For instance, fluid conduits of the present disclosure may be used in a borehole used for placement of utility lines, or in a bit used for a machining or manufacturing process. Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "coupled," "attached," "connected," "secured," and the like are intended to encompass connections that are both direct and indirect. Features that are integrally formed from a monolithic body are also to be considered coupled, attached, connected, or secured together.

Additionally, it should be understood that references to "one embodiment" or "an embodiment" of the present disclosure are not intended to be interpreted as excluding the existence of additional embodiments that also incorporate the recited features. For example, any element described in relation to an embodiment herein is combinable with any element of any other embodiment described herein, unless such features are described as, or by their nature are, mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where ranges are described in combination with a set of potential lower or upper values, each value may be used in an open-ended range (e.g., at least 50%, up to 50%), as a single value, or two values may be combined to define a range (e.g., between 50% and 75%).

It should be understood that any directions or reference frames in the preceding description are merely relative directions or movements. For example, any references to "up" and "down" or "above" or "below" are merely descriptive of the relative position or movement of the related elements. The term "may" when used with components or features is intended to indicate that such features are provided by some embodiments, but other embodiments are contemplated which do not include such components or features. Features of any embodiment disclosed herein may be used in combination with features of any one or more other embodiments. For instance, cutting tools with customized hydraulics may be produced with material composition variations in one or more directions, although they may also be produced without such variations.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. Features of various embodiments may be used in any combination, except where such features are clearly mutually exclusive. While cutting tools having customized hydraulics may be produced using additive manufacturing and gradients according to other embodiments disclosed herein, but may be produced without such gradients.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A bit for removing material from a formation, the bit comprising:

a bit body;

a blade coupled to the bit body, the blade defining a nose region and a shoulder region;

a plurality of cutting elements coupled to the blade in the nose region and the shoulder region, at least one cutting element of the plurality of the cutting elements having a cutting face having a diameter; and a plurality of fluid outlets, the plurality of fluid outlets positioned such that at least 70% of a totality of the cutting elements have at least one fluid outlet positioned an outlet distance equal to or less than three times the diameter of the cutting element away from the cutting face of the at least one cutting element.

2. The bit of claim 1, further comprising a nozzle positioned in the bit body, the nozzle having a nozzle diameter and the plurality of fluid outlets having a fluid outlet diameter, the nozzle diameter being greater than the fluid outlet diameter.

3. The bit of claim 1, the bit having three or fewer primary blades.

4. The bit of claim 1, the plurality of cutting elements being arranged at least in a row of primary cutting elements on the blade and at least one row of secondary cutting elements on the blade, the at least one row of secondary cutting elements positioned rotationally behind the row of primary cutting elements.

5. The bit of claim 4, at least one fluid outlet of the plurality of fluid outlets being positioned between the row of primary cutting elements and the at least one row of secondary cutting elements.

6. The bit of claim 1, at least 10% of the totality of the fluid outlets being positioned an outlet distance equal to or less than 50% the diameter of the cutting element away from the cutting face of at least one of the plurality of cutting elements.

7. The bit of claim 6, the nose region and shoulder region of the bit having a fluid outlet to cutting element ratio of at least 0.5.

8. The bit of claim 7, each of the fluid outlets of the plurality of fluid outlets having a fluid path, and at least one of the plurality of cutting elements positioned on the nose region and shoulder region having a fluid path directed at or across the cutting face of the at least one cutting element.

9. The bit of claim 1, at least one fluid outlet of the plurality of fluid outlets having a fluid conduit providing fluid communication to the at least one fluid outlet, the fluid conduit tapering inward or outward at the at least one fluid outlet.

10. The bit of claim 1, each of the fluid outlets of the plurality of fluid outlets having an outlet diameter and each of the outlet diameters being at least 0.075 in. (1.91 mm).

11. The bit of claim 1, the plurality of cutting elements including a row of primary cutting elements on the blade and at least one row of secondary cutting elements on the blade, the at least one row of secondary cutting elements positioned rotationally behind the row of primary cutting elements, and at least one of the fluid outlets of the plurality of fluid outlets being a primary fluid outlet and configured to provide fluid to the row of primary cutting elements and at least one of the fluid outlets of the plurality of fluid outlets being a secondary fluid outlet and configured to provide fluid to the at least one row of secondary cutting elements, the primary fluid outlet having an outlet diameter greater than an outlet diameter of the secondary fluid outlet.

12. The bit of claim 1, each cutting element of the plurality of cutting elements in the nose region and the shoulder region being associated with an associated fluid outlet of the plurality of fluid outlets.

13. A drill bit, comprising:

a bit body, the bit body having a central conduit and a chamber at the end of the central conduit configured to convey drilling fluid through the bit body;

a blade coupled to the bit body;

a plurality of cutting elements coupled to the blade, at least one cutting element of the plurality of the cutting elements having a cutting face having a diameter;

a plurality of fluid outlets, the plurality of fluid outlets positioned such that at least 10% of a totality of the cutting elements have a fluid outlet positioned a distance equal to or less than 100% the diameter of the cutting face away from the cutting face of the cutting element; and a primary conduit branching from the chamber and a first fluid conduit branching from the primary conduit to direct the drilling fluid to at least one fluid outlet of the plurality of fluid outlets.

14. The drill bit of claim 13, the first fluid conduit providing fluid communication to a first fluid outlet of the at least one fluid outlet and further comprising a second fluid conduit branching from the primary conduit and providing fluid communication between the primary conduit and at least a second fluid outlet of the at least one fluid outlet.

15. The drill bit of claim 13, at least one of the primary conduit or the first fluid conduit having a non-linear path.

16. The drill bit of claim 13, at least one of the primary conduit or the first fluid conduit having a fluid path with a nonzero fluid path angle relative to a rotational axis of the bit body.

17. The drill bit of claim 13, the plurality of fluid outlets being formed on the blade and being recessed relative to the plurality of cutting elements.

18. A bit for removing material from a formation, the bit comprising:

a bit body;

a blade coupled to the bit body, the blade defining a nose region and a shoulder region;

a plurality of cutting elements coupled to the blade in the nose region and the shoulder region, at least one cutting element of the plurality of the cutting elements having a cutting face having a diameter;

a nozzle having a nozzle diameter; and a plurality of fluid outlets having a fluid outlet diameter, the fluid outlet diameter being less than the nozzle diameter, the plurality of fluid outlets positioned such that at least 60% of the totality of cutting elements have at least one fluid outlet positioned an outlet distance equal to or less than three times the diameter of the cutting element away from the cutting face of the at least one cutting element.

19. The bit of claim 18, the nozzle being located in a junk slot and not on the blade.

20. The bit of claim 18, plurality of fluid outlets being formed on the blade.

* * * * *